US011465261B1

(12) United States Patent
Lee

(10) Patent No.: US 11,465,261 B1
(45) Date of Patent: Oct. 11, 2022

(54) RECIPROCAL SEGMENT ABRASIVE CUTTING TOOL

(71) Applicant: Dixie Diamond Manufacturing, Inc., Lilburn, GA (US)

(72) Inventor: Yong Wook Lee, Lilburn, GA (US)

(73) Assignee: Dixie Diamond Manufacturing, Inc., Liburn, GA (US)

( * ) Notice: Subject to any disclaimer, the term of this patent is extended or adjusted under 35 U.S.C. 154(b) by 0 days.

(21) Appl. No.: 17/466,702

(22) Filed: Sep. 3, 2021

(51) Int. Cl.

| | |
|---|---|
| ***B24D 5/12*** | (2006.01) |
| ***B24D 5/06*** | (2006.01) |
| ***B24D 5/14*** | (2006.01) |
| ***B24D 7/06*** | (2006.01) |
| ***B24D 7/14*** | (2006.01) |
| ***B24D 99/00*** | (2010.01) |

(52) U.S. Cl.
CPC ..... *B24D 5/12* (2013.01); *B24D 5/063* (2013.01); *B24D 5/066* (2013.01); *B24D 5/123* (2013.01); *B24D 5/14* (2013.01); *B24D 7/063* (2013.01); *B24D 7/14* (2013.01); *B24D 99/005* (2013.01)

(58) Field of Classification Search
CPC ..... B24D 5/06; B24D 5/063; B24D 5/066; B24D 5/08; B24D 5/12; B24D 5/123; B24D 5/14; B24D 7/06; B24D 7/063; B24D 7/08; B24D 7/14; B24D 99/00
USPC ..... 451/57, 541, 542, 543, 544, 546, 547, 451/548
See application file for complete search history.

(56) References Cited

U.S. PATENT DOCUMENTS

| | | | | |
|---|---|---|---|---|
| 3,203,774 A * | 8/1965 | Pratt | B24D 5/14 | 51/293 |
| 5,123,217 A * | 6/1992 | Ishikawa | B28D 1/146 | 175/425 |
| 5,518,443 A * | 5/1996 | Fisher | B24D 3/06 | 451/540 |
| 5,868,125 A * | 2/1999 | Maoujoud | B24D 3/06 | 125/15 |
| 6,033,295 A * | 3/2000 | Fisher | E21B 10/48 | 451/540 |
| 6,110,031 A * | 8/2000 | Preston | B24D 5/14 | 451/527 |
| 6,196,911 B1 * | 3/2001 | Preston | B24D 7/06 | 451/529 |
| 6,533,650 B2 * | 3/2003 | Yoshida | B24D 7/08 | 451/547 |

(Continued)

*Primary Examiner* — Eileen P Morgan
(74) *Attorney, Agent, or Firm* — Troutman Pepper Hamilton Sanders LLP; James E. Schutz; Korbin M. Blunck

(57) ABSTRACT

The disclosed technology includes an abrasive cutting tool having a plurality of segments arranged around a periphery of the cutting tool. The plurality of segments can include a first segment having a first portion having a first concentration of abrasive material, and a second portion having a second concentration of abrasive material. The second concentration can be less than the first concentration. The cutting tool can have a second segment having a third portion having a concentration of abrasive material that can be similar to the concentration of the first portion, and a fourth portion having a concentration of abrasive material that can be similar to the concentration of the second portion. The first portion and the second portion can be reciprocally arranged in relation to the third portion and the fourth portion around the periphery of the cutting tool.

11 Claims, 19 Drawing Sheets

(56) References Cited

U.S. PATENT DOCUMENTS

| | | | | |
|---|---|---|---|---|
| 6,626,167 | B2 * | 9/2003 | Kim | B24D 5/123 125/15 |
| 6,712,062 | B2 * | 3/2004 | Wildenburg | B24D 5/123 451/529 |
| 7,695,353 | B2 * | 4/2010 | Moroto | B24D 5/14 451/541 |
| 7,954,483 | B2 * | 6/2011 | Kim | B28D 1/121 125/22 |
| 9,321,184 | B2 * | 4/2016 | Baker | B24D 7/14 |
| 2006/0006002 | A1 * | 1/2006 | Mugg | B23D 61/028 175/56 |
| 2008/0219783 | A1 * | 9/2008 | Kim | B24D 5/123 407/114 |
| 2010/0147279 | A1 * | 6/2010 | Baraldi | B24D 5/123 125/15 |
| 2014/0010998 | A1 * | 1/2014 | Hoang | B24D 99/005 428/172 |
| 2019/0134782 | A1 * | 5/2019 | Tateishi | B24B 41/047 |

* cited by examiner

RECIPROCAL SEGMENT ABRASIVE CUTTING TOOL

FIELD OF THE DISCLOSURE

The present invention relates generally to cutting tools, and more particularly, to cutting tools having abrasive segments in a reciprocal arrangement.

BACKGROUND

Abrasive cutting tools are commonly used for cutting, drilling, grinding, sanding, polishing, lapping, planing, jointing, or other applications where material is removed by use of a tool having abrasive material. Abrasive cutting tools generally consist of abrasive material suspended in a matrix material and affixed to a periphery of the cutting tool. In some applications, abrasive cutting tools have abrasive material that extends continuously along a periphery of the abrasive cutting tool. In other applications, abrasive cutting tools have distinct segments attached to a surface of the abrasive cutting tool with each segment comprising abrasive material. The segments may be spaced from each other by, for example, a gullet which can help to remove chips and debris and also help cool the abrasive cutting tool. For example, saw blades used to cut concrete, asphalt, metal, or other hard materials commonly have multiple segments (or "teeth") with abrasive material that are affixed to the outer circumference of the saw wheel. As the saw wheel turns, the segments are rotated toward and against a workpiece (or the material to be cut) and the abrasive material removes pieces of material from the workpiece.

The size, rotation rate, feeding rate, and cutting depth of the tool as well as the type, size, quality, concentration, and positioning of the abrasive material in combination with the selected matrix material can affect the performance and the useable life of the abrasive cutting tool. Furthermore, the shape, spacing, and arrangement of the segments along the periphery of the cutting tool can help to extend the life of the cutting tool. Unfortunately, even with optimizing the various features of the abrasive cutting tool just described, abrasive cutting tools tend to wear out and become very hot during use because of the frictional forces that are present during a cutting operation. If the abrasive cutting tool is operated too quickly, on the wrong material, or without a necessary cooling fluid, the life of the cutting tool can be dramatically reduced. To help reduce the heat generated by the abrasive cutting tool, some segments attached to the abrasive cutting tool comprise both a relatively soft portion and a relatively hard portion. The soft portion tends to wear more quickly than the hard portion over time but also generates less heat than the hard portion. Unfortunately, some abrasive cutting tools which have segments with both soft and hard portions tend to have a shorter useable life than is desirable. This is particularly true when the speed of the cutting tool is increased.

What is needed, therefore, is an abrasive cutting tool having segments that are configured to increase and maintain the sharpness of the segments by controlling the chip sizes and reducing the heat generated by the abrasive cutting tool to extend the useable life of the cutting tool.

SUMMARY

These and other problems can be addressed by the technologies described herein. Examples of the present disclosure relate generally to cutting tools, and more particularly, to cutting tools having abrasive segments in a reciprocal arrangement.

The disclosed technology can include an abrasive cutting tool having a plurality of segments arranged around a periphery of a cutting tool. The segments can include a first segment having a first portion having a first concentration of abrasive material and a second portion having a second concentration of abrasive material. The second concentration can be less than the first concentration.

The segments can further include a second segment having a third portion having a concentration of abrasive material that can be similar to the concentration of the first portion and a fourth portion having a concentration of abrasive material that can be similar to the concentration of the second portion. The first portion and the second portion can be reciprocally arranged in relation to the third portion and the fourth portion.

In some examples, the first portion and the second portion of the first segment and the third portion and the fourth portion of the second segment can be aligned with a cutting direction of the abrasive cutting tool. The first segment can include a plurality of first portions and a plurality of second portions and the second segment can include a plurality of third portions and a plurality of fourth portions. The plurality of first portions and the plurality of second portions can extend along a length of the first segment in a cutting direction of the abrasive cutting tool. Similarly, the plurality of third portions and the plurality of fourth portions can extend along a length of the second segment in the cutting direction of the abrasive cutting tool. Each first portion, second portion, third portion, and fourth portion can extend along the length of the first segment in the cutting direction of the abrasive cutting tool.

The plurality of first portions and the plurality of second portions can be arranged in an alternating pattern along a width of the first segment and the plurality of third portions and the plurality of fourth portions can be arranged in an alternating pattern along a width of the second segment. In other examples, the plurality of first portions and the plurality of second portions can be reciprocally arranged along the length of the first segment in the cutting direction of the abrasive cutting tool. Similarly, the plurality of third portions and the plurality of fourth portions can be reciprocally arranged along the length of the second segment in the cutting direction of the abrasive cutting tool.

The plurality of segments can include a plurality of first segments and a plurality of second segments arranged such that each first segment is adjacent a second segment and each first segment is reciprocally arranged in relation to each second segment.

The plurality of segments can include a plurality of first segments and a plurality of second segments arranged such that at least two first segments are adjacent each other and are aligned such that the first portion of each of the at least two first segments are aligned in a cutting direction of the abrasive cutting tool.

The first and second concentration of abrasive material can include abrasive material that is randomly dispersed throughout the first portion and the second portion, respectively. In other examples, the first concentration of abrasive material can include abrasive material that is arranged in an array throughout the first portion and the second concentration of abrasive material can include abrasive material that is arranged in an array throughout the second portion. The first concentration of abrasive material can include arranging the abrasive material in the array by spacing each piece of abrasive material a first distance in any direction from an adjacent piece of abrasive material and the second concentration of abrasive material comprises arranging the abrasive material in the array by spacing each piece of abrasive material a second distance in any direction from an adjacent piece of abrasive material. The second distance can be greater than the first distance. The first concentration of abrasive material can be zero. The abrasive material of the first portion and the abrasive material of the second portion can be diamond.

Each segment can be separated from an adjacent segment by a first distance. In other examples, each segment can abut an adjacent segment such that the plurality of segments extends continuously along the periphery of the abrasive cutting tool in a first direction.

The disclosed technology can include an abrasive cutting tool having a plurality of segments arranged around a periphery of a cutting tool. The abrasive cutting tool can have a first segment having a first portion having abrasive material suspended in a first matrix material and having a first hardness, and a second portion having abrasive material suspended in a second matrix material and having a second hardness. The first hardness can be greater than the second hardness. The abrasive cutting tool can further include a second segment having a third portion having abrasive material suspended in a third matrix material and having a third hardness, and a fourth portion having abrasive material suspended in a fourth matrix material and having a fourth hardness. The first portion and the second portion can be reciprocally arranged in relation to the third portion and the fourth portion.

In some examples, the matrix material of the first portion can be a matrix material having a greater durability than the matrix material of the second portion. In some examples, a concentration of the abrasive material suspended in the first portion can be approximately equal to a concentration of the abrasive material suspended in the second portion. In some examples, the second hardness can be greater than the third hardness.

The disclosed technology can include a method of manufacturing an abrasive cutting tool. The method can include preparing a first compound comprising a first concentration of abrasive material and a matrix material and preparing a second compound comprising a second concentration of abrasive material and the matrix material. The second concentration of abrasive material can be less than the first concentration of abrasive material.

The method can further include preparing a third compound similar to the first compound and preparing a fourth compound similar to the second compound. The method can include cold pressing the first compound together with the second compound and cold pressing the third compound together with the fourth compound. The method can include sintering the first compound together with the second compound to form a first segment having a first portion comprising the first compound and a second portion comprising the second compound. The method can include sintering the third compound together with the fourth compound to form a second segment having a third portion comprising the third compound and a fourth portion comprising the fourth compound.

The method can include affixing the first segment and the second segment to a periphery of the abrasive cutting tool such that the first portion and the second portion are reciprocally arranged in relation to the third portion and the fourth portion.

The first portion and the second portion of the first segment and the third portion and the fourth portion of the second segment can be aligned with a cutting direction of the abrasive cutting tool.

Preparing the first compound and the second compound can include randomly dispersing the first concentration of abrasive material in the matrix material. As another example, preparing the first compound can include arranging the first concentration of abrasive material in an array in the matrix material by spacing each piece of abrasive material a first distance from an adjacent piece of abrasive material and preparing the second compound comprises arranging the second concentration of abrasive material in an array in the matrix material by spacing each piece of abrasive material a second distance from an adjacent piece of abrasive material. The second distance can be greater than the first distance.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

The accompanying drawings, which are incorporated in and constitute a part of this specification, illustrate various aspects of the presently disclosed subject matter and serve to explain the principles of the presently disclosed subject matter. The drawings are not intended to limit the scope of the presently disclosed subject matter in any manner.

DETAILED DESCRIPTION

Figure 1:
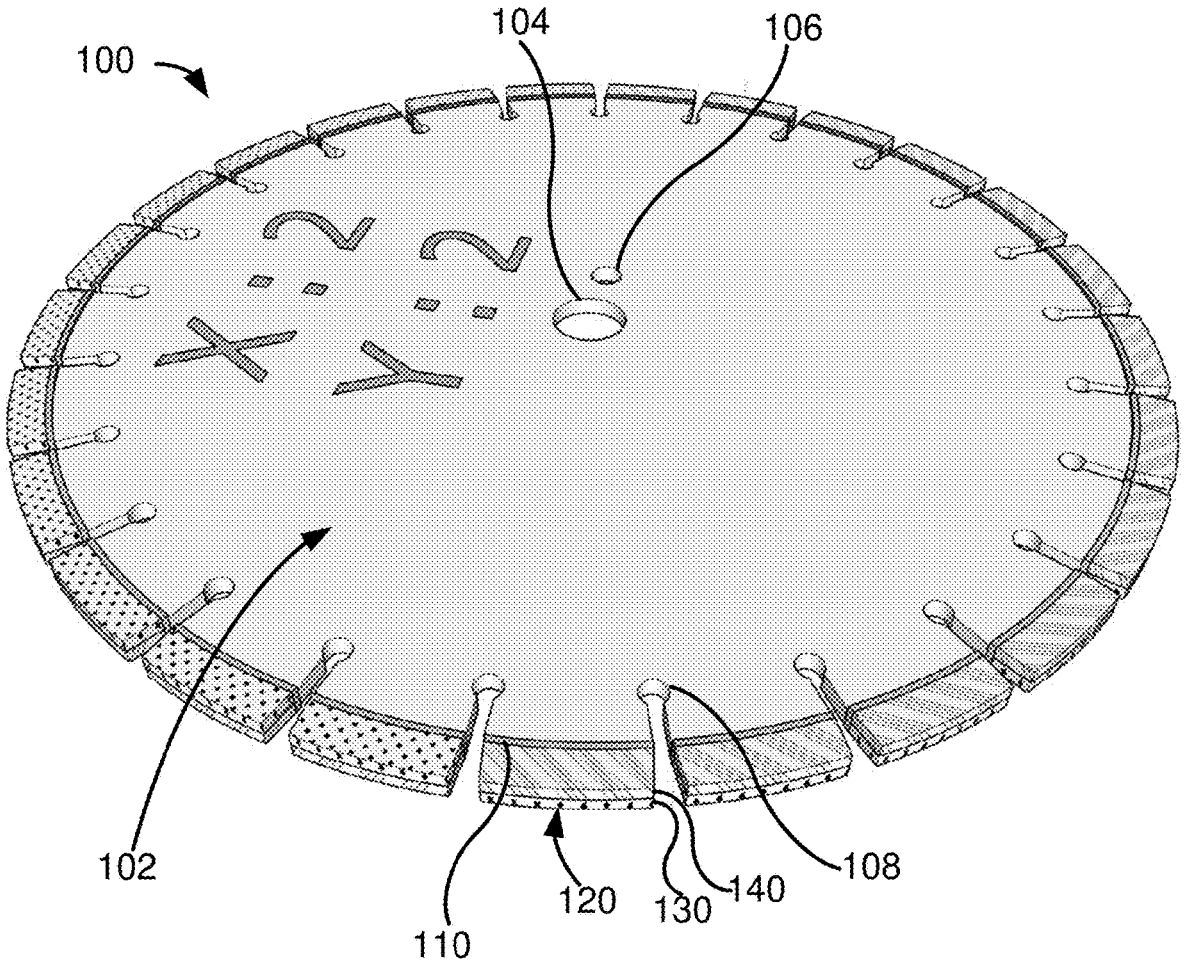
FIG. 1 illustrates a perspective view of an abrasive cutting tool, in accordance with the disclosed technology.

The disclosed technology can include an abrasive cutting tool having various segments attached to a periphery of the cutting tool. To illustrate, the cutting tool can be a saw blade having a number of segments attached to the outer circumference of the saw wheel. Each segment can include various portions having a differing concentration of abrasive material. For example, a segment can have a first portion having a first concentration of abrasive material and a second portion having a second, lower, concentration of abrasive material. As will be appreciated by one of skill in the art, the portion having a higher concentration of abrasive material will generally be more durable and last longer than the portion having a lower concentration of abrasive material. The portion having a lower concentration of abrasive material, however, will generally wear faster but generate less heat than the section having a higher concentration of abrasive material. The segments can be affixed to the periphery of the cutting tool such that a segment is reciprocally arranged in relation to an adjacent segment. In other words, the first portion of a first segment can be reciprocally arranged in relation to a first portion of an adjacent segment. As will become apparent throughout this disclosure, by affixing the segments to the periphery of the cutting tool in a reciprocal arrangement, the useable life of the cutting tool can be extended compared to existing cutting tools having abrasive segments.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being a saw blade or cutting disc having abrasive segments in a reciprocal arrangement. The present disclosure, however, is not so limited, and can be applicable in other contexts. The present disclosure can, for example, include apparatuses used for cutting, drilling, grinding, sanding, polishing, lapping, planing, jointing, coring, widening or beveling a cut, or other applications wherein material can be removed by use of a tool having abrasive segments. Accordingly, when the present disclosure is described in the context of a cutting disc having abrasive segments in a reciprocal arrangement, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring now to the drawings, in which like numerals represent like elements, the present disclosure is herein described. To help explain the disclosed technology, FIG. 1 illustrates an example of an abrasive cutting tool which is a saw blade 100. As will become apparent throughout this disclosure, however, the saw blade 100 illustrated in many of the figures and described herein is only one example implementation of the disclosed technology. The disclosed technology can be applied to various other cutting tools such as, for example, cutting discs, grinding wheels, core drilling bits, chain saw chains, circular saw blades, bandsaw blades, reciprocating saw blades, cutting wires, and various other cutting tool applications. Thus, the disclosed technology should not be limited to the various example applications shown in the figures and described herein.

FIG. 1 illustrates a saw blade 100 having a wheel 102, an arbor hole 104, a drive pin hole 106, gullets 108, and segments 120 attached to an outer circumference of the wheel 102 by a welding material 110. For the sake of simplicity, only a single segment 120 is referenced in FIG. 1 but one of skill in the art will appreciate that the saw blade 100 can have multiple segments attached to the outer circumference of the wheel 102, as shown in FIG. 1, with each segment 120 having a similar configuration. Each segment 120 can include a first portion 130 and a second portion 140. As will be described in greater detail herein, the first portion 130 can be harder than a second portion 140 such that the first portion 130 is configured to remove more material than the second portion 140. For example, the first portion can include a first concentration of abrasive material that is embedded in a matrix material and the second portion 140 can include a second concentration of abrasive material that is embedded in a matrix material. The first concentration of abrasive material can be greater than the second concentration of abrasive material such that the first portion 130 can have a greater durability than the second portion 140. In other words, because the first portion 130 comprises a higher concentration of abrasive material than the second portion 140, the first portion 130 will wear away more slowly than the second portion 140 and therefore will have a longer useable life than the second portion 140. In some examples, the second portion 140 may not have any abrasive material to ensure the second portion 140 wear more quickly than the first portion 130. In other examples, the type, size, quality, concentration, and/or positioning of abrasive material in the first portion 130 can be varied in relation to the type, size, quality, concentration, and/or positioning of abrasive material in the second portion 140. Furthermore, the matrix material used in the first portion 130 can be a matrix material having different material properties than a matrix material used in the second portion 140 to ensure the first portion 130 is more durable than the second portion 140. For example, the first portion 130 can have a matrix material that has a higher hardness than the matrix material used in the second portion 140 such that, even if the concentration of abrasive material in the first portion and second portion are approximately equal, the second portion 140 can be configured to wear down more quickly than the first portion 130. The matrix material used in the first portion 130 can be the same type or a different type of matrix material used in the second portion 140. In still other examples, the first portion 130 can include a combination of abrasive material and matrix material that, when combined, helps to ensure the first portion 130 is more durable than the second portion 140.

As will be appreciated by one of skill in the art with the benefit of this disclosure, the disclosed technology has been described as having a segment 120 with a first portion 130 and a second portion 140 for illustrative purposes, but the disclosed technology is not so limited. Although the segments 120 are described herein as having a first portion 130 that is harder than a second portion 140, the segments 120 can have any number of portions having differing material properties. For example, a single segment 120 can have three, four, five, ten, twenty, fifty, or even more than one hundred different portions with each portion having differing material properties. Thus, the disclosed technology should not be construed as being limited to a segment 120 having only a first portion 130 and a second portion 140. Similarly, the number of portions on one segment 120 can be the same as or different from an adjacent segment 120 adhered to the periphery of the cutting tool. For example and not limitation, a first segment 120 can have a single first portion 130 and a single second portion 140 while an adjacent segment 120 can have two first portions 130 and two second portions 140.

The segments 120 can be arranged around the periphery of the saw blade 100 such that a segment 120 is reciprocally arranged in relation to an adjacent segment 120. In other words a first portion 130 and a second portion 140 of a first segment 120 can be reciprocally arranged in relation to a first portion 130 and a second portion 140 of a second segment 120. As will be appreciated, because the concentration of abrasive material in a first portion 130 may not be exactly equal to the concentration of abrasive material in first portion 130 of a second segment 120, the first portion 130 of the second segment 120 may be referred to as a third portion for explanatory purposes. Similarly, because the concentration of abrasive material in a second portion 140 may not be exactly equal to the concentration of abrasive material in a second portion 140 of a second segment 120, the second portion 140 of the second segment 120 may be referred to as a fourth portion for explanatory purposes. Furthermore, the hardness of the first portion 130 and the second portion 140 can be varied according to any of the examples disclosed herein (e.g., varying the type, size, quality, concentration, and/or positioning of abrasive material and/or varying the material properties of the matrix). In some examples, the first portion 130 of a first segment 120 can have a hardness that is similar to the first portion 130 of a second segment 120. Similarly, the second portion 140 of the first segment 120 can have a hardness that is similar to the second portion 140 of a second segment 120.

In other examples, the first portion 130 on a first segment 120 may intentionally comprise different material properties (i.e., the material properties of the abrasive material and the matrix material) than a first portion 130 on a second segment 120 (i.e., a "third portion"). Similarly, the second portion 140 on a first segment 120 can intentionally comprise different material properties than a second portion 140 on a second segment 120 (i.e., a "fourth portion"). In doing so, the performance of the saw blade 100 can be tailored to the specific material to be cut and the specific cutting application. In some examples a first segment 120 may have a first portion 130 having a first hardness and a second portion 140 having a second hardness while a second segment may have a first portion 130 (i.e., a "third portion") having a third hardness and a second portion 140 (i.e., a "fourth portion") having a fourth hardness. The hardness of the first portion 130, second portion 140, third portion 130, and fourth portion 140 can be varied to fit a particular application. For example, the first portion 130 can be harder than the second portion 140, the third portion 130 can be harder than the fourth portion 140, and the fourth portion 140 can be harder than the first portion 130. In other examples, the first portion 130 can be harder than the second portion 140, the third portion 130 can be harder than the fourth portion 140, but the fourth portion 140 can be softer than the first portion 130. As will be appreciated by one of ordinary skill in the art, other configurations of segments 120 can be achieved by varying the hardness of the first portion 130 and second portion 140 while still remaining within the scope of this disclosure.

Although the saw blade 100 is shown as having twenty-five segments 120, the saw blade 100 can have any number of segments as would be suitable for the particular application. For example, the saw blade 100 can have as little as two segments 120 or more than five hundred segments 120 depending on size of the wheel 102 and the size of the segments 120. As will be appreciated, the size of the wheel 102 and the size of the segments 120 can vary depending on the material to be cut and in what situation the saw blade 100 will be used. In other examples, the saw blade 100 can have segments 120 that extend continuously along the outer circumference of the wheel 102 such that the saw blade 100 does not have any gullets 108 or spacing between adjacent segments 120. Similar comparison can be made for additional segments 120 of the saw blade 100 for explanatory purposes.

The wheel 102 can be made from any suitable material for the application. For example, the wheel 102 can be made from carbon steel, high speed steel, stainless steel, tungsten carbide, composite materials, or any other suitable metal, polymer, ceramic material for the application. Furthermore, the wheel 102 can be heat treated to increase the strength of the wheel 102. Although the saw blade 100 is shown as having an arbor hole 104 and a drive pin hole 106, one of skill in the art will appreciate that the saw blade 100 can have various bolt patterns or other configurations to facilitate attaching the saw blade 100 to a saw or other cutting tool.

Each segment 120 can be separated from an adjacent segment 120 by a gullet 108. As will be appreciated, the gullet 108 can be configured to facilitate removal of chips and other debris that can present while the saw blade 100 is cutting. The gullets 108 can also be configured to help cool the saw blade 100 while in use. The size and shape of the gullet 108 can vary depending on the application. Furthermore, as shown in FIG. 1, the gullet 108 can include a rounded portion to help reduce stress concentrations which may otherwise lead to cracking of the wheel 102.

As stated previously, each segment 120 can be attached to the wheel 102 by a welding material 110. As will be appreciated by one of skill in the art, the welding material 110 can be any type of welding material and process that can attach the segment 120 to the wheel 102. For example, the welding material 110 can be a solder such as a silver solder that can be used to solder or weld the segments 120 to the wheel 102. As another other example, the welding material 110 can be material formed by sintering, arc welding, tungsten inert gas (TIG) welding, metal inert gas (MIG) welding, or brazing the segment 120 together with the wheel 102. As yet another example, the welding material 110 can be material formed by laser welding the segment 120 together with the wheel 102. In yet other examples, the segments 120 can be adhered directly to the cutting tool with the matrix material in which the abrasive material is suspended.

Figure 2:
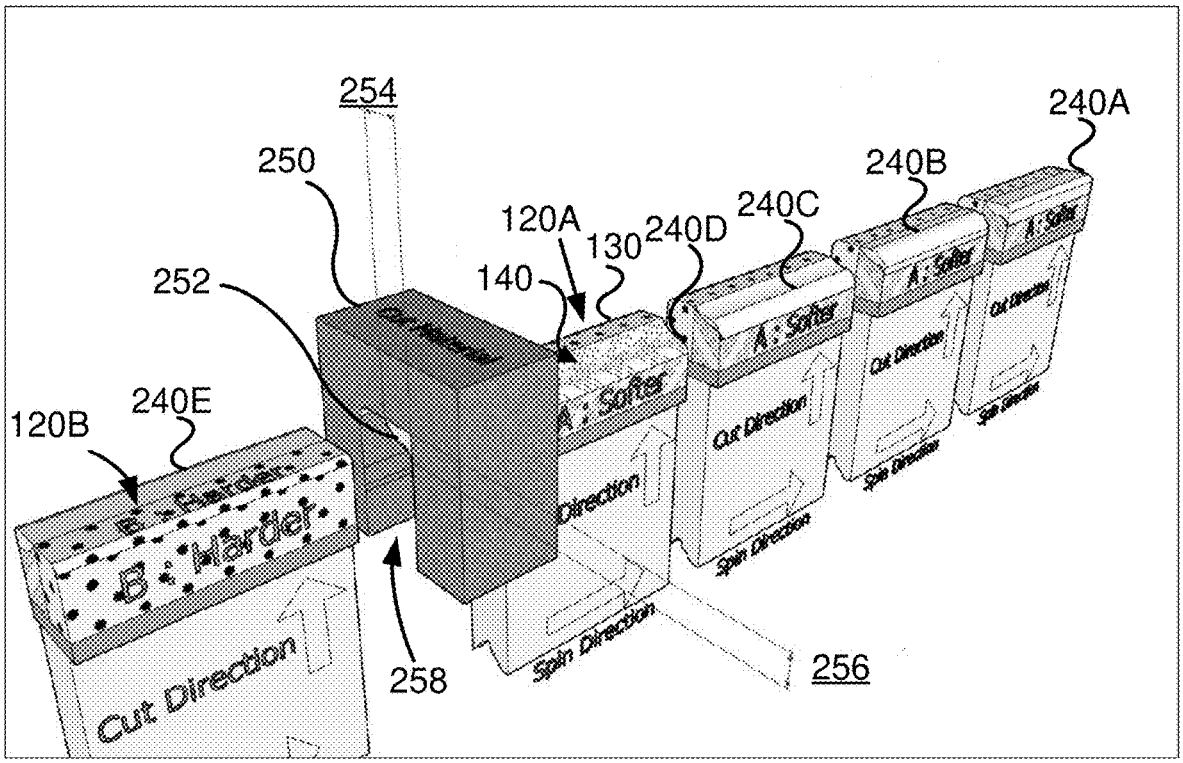
FIG. 2 is an illustration of the segments of the cutting tool removing material from an object to be cut, in accordance with the disclosed technology.

As illustrated in FIG. 1, at least some of the segments 120 can be reciprocally arranged in relation to adjacent segments 120 of the saw blade 100. The saw blade 100 can have roughly half of the periphery of the wheel 102 include segments 120 that can be reciprocally arranged in relation to the remaining segments 120 as shown in FIG. 1. To illustrate, the specific example illustrated in FIG. 1 illustrates the saw blade 100 having twenty-five segments 120 attached to the outer circumference of the wheel 102. Furthermore, thirteen of the segments 120 are shown as being attached to the outer circumference of the wheel 102 in a first orientation while the remaining 12 segments 120 are shown as being attached to the outer circumference of the wheel 102 in a second orientation. In other words, at least some of the segments 120 are reciprocally arranged in relation to an adjacent segment 120. As will become apparent throughout this disclosure, in this way, the disclosed technology can facilitate more efficient cutting of a cut material or workpiece FIG. 2 is a detail view of segments 120 as they are passed through a cut material 250 and remove chips 252 from the cut material 250. As will be appreciated by one of ordinary skill in the art, FIG. 2 illustrates the segments 120 as they would appear as they begin to wear down over time through use. In particular, the second portion 140 (which is softer than the first portion 130) will begin to wear down faster over time than the first portion 130 as the saw blade 100 is used to cut material. To help illustrate this feature, the second portion 140 is shown having worn portions 240A-240E. In particular, worn portions 240A-240D illustrate how the second portion 130 will wear down over time. As can be seen in FIG. 2, the second portion 140 can initially have a height close to the height of the first portion 130 as shown by worn portion 240A. The second portion 140, however, will wear down over time and become shorter than the first portion 130 as shown by worn portion 240D. As will be appreciated, worn portion 240D illustrates a segment 120 that has been used more than worn portion 240C. Similarly, worn portion 240C illustrates a segment 120 which has been used more than worn portion 240B and worn portion 240B illustrates a segment which has been used more than worn portion 240A.

As can be seen in FIG. 2, by attaching the segments 120 around the periphery of the saw blade 100 in a reciprocal arrangement, the segments 120 can be configured such that the first portion 130 (which is harder than the second portion 140) of a second segment 120B can be configured to remove material which can be left behind by the second portion 140 (which is softer than the first portion 130) of a first segment 120A. In other words, as a segment 120 (e.g., first segment 120A) passes through the cut material 250, the softer second portion 140 will wear down over time, leaving behind a chip 252 in the kerf 258 of the cut material 250 when the saw blade 100 is passed through the cut material 250. This chip 252 can be removed by the first portion 130 of the second segment 120B which is passed through the cut material 250 after the first segment 120A is passed through the cut material 250. As will be appreciated, the second segment 120B can have a similar worn portion 240B which can be reciprocally arranged in relation to the worn portion 240A of the first segment 120A. Thus, although not shown in FIG. 2, as the second segment 120B is passed through the cut material 250 the worn portion 240B can similarly leave behind a chip 252 that would be on the opposite side of the kerf 258 of the cut material 250.

The chip 252 will have a width 254 corresponding to the width of the worn portion 240A, 240B of the second portion 140 that has been worn down over time. Similarly, the chip 252 will have a height 256 corresponding to the height of the worn portion 240A, 240B of the second portion 140 that has been worn down over time. The worn portion 240A is illustrated as being slowly worn down over time in FIG. 2 for illustrative purposes. As will be appreciated, the size of the worn portion 240A, 240B and the rate at which the worn portion 240A, 240B begins to wear down will be related to the type of material being cut, the size of the second portion 140 itself, the concentration of abrasive material in the second portion 140, the quality of the abrasive material in the second portion 140, the size of the abrasive material in the second portion 140, the material properties of the matrix in which the abrasive material is suspended, the speed at which the saw blade 100 is rotated and moved in the cutting direction of the saw blade 100, whether a cooling fluid was used with the saw blade 100, and other factors which could similarly impact the rate at which the second portion 140 is worn down. No matter the configuration, because the second portion 140 is a softer material than the first portion 130, it is likely that the second portion 140 will wear down faster than the first portion 130. Thus, the first portion 130 can begin to protrude from the saw blade 100 over time and will therefore be configured to remove the chip 252 from the cut material 250 which is left behind by the worn portion 240A, 240B of the second portion 140.

Figure 3A:
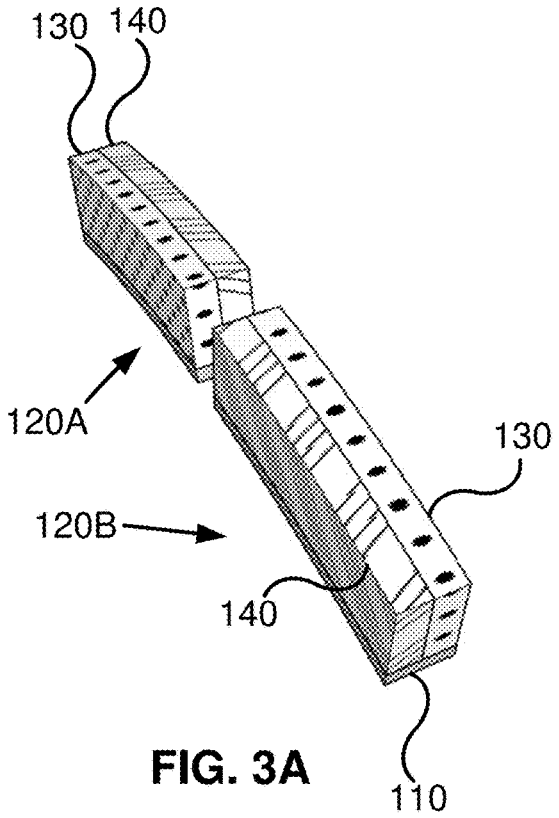
FIGS. 3A-3D illustrate perspective views of segments of the abrasive cutting tool, in accordance with the disclosed technology.
Figure 3B:
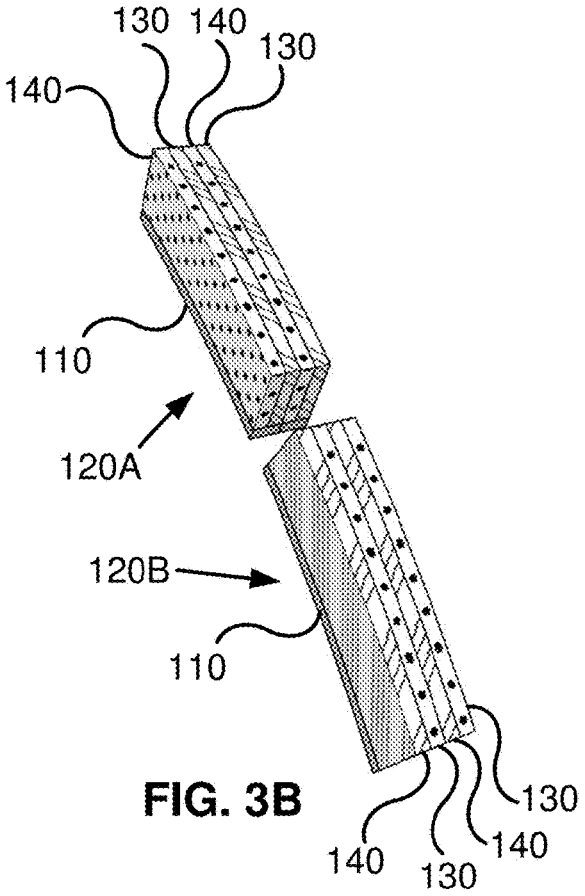
Figure 3C:
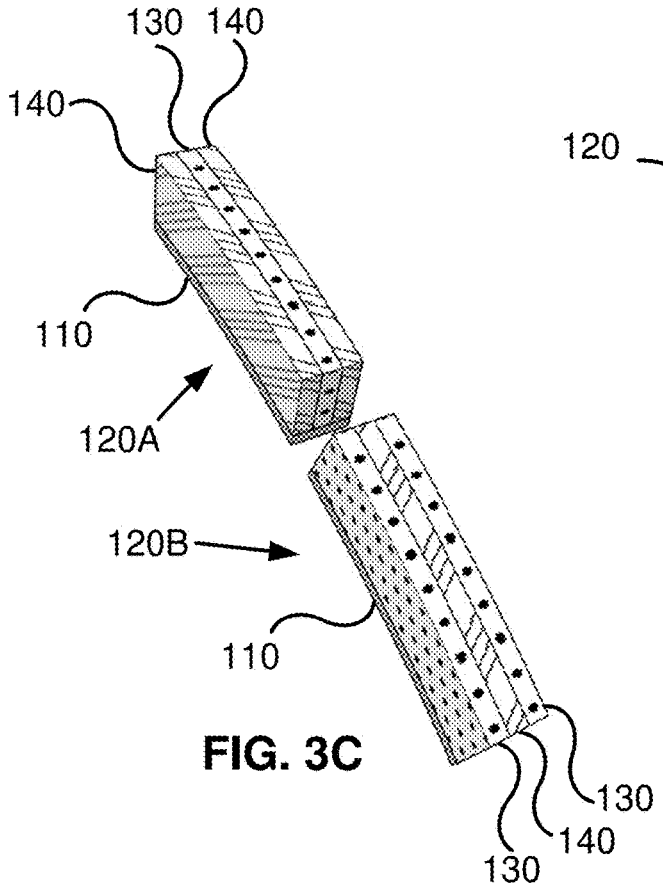
Figure 3D:
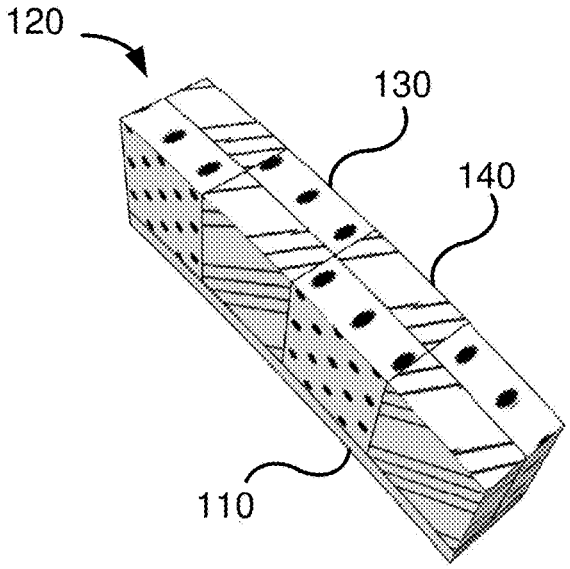

FIGS. 3A-3D illustrate perspective views of segments 120 of the saw blade 100, in accordance with the disclosed technology. The segments 120 shown and described in FIGS. 3A-3D are shown in FIGS. 1-2 and FIGS. 4-6 and reference will be made to the respective segments 120 herein. As will be appreciated, the segments 120 shown and described herein can be applied to any abrasive cutting tool but are shown and described in relation to the saw blade 100 for illustrative purposes. The segments 120 shown in FIGS. 3A-3C are each shown as being a first segment 120A adjacent a second segment 120B to illustrate that each segment 120 can be reciprocally arranged in relation to an adjacent segment 120. FIG. 3D, on the other hand, illustrates a single segment 120 having multiple first portions 130 and second portions 140 that are reciprocally arranged along the length of the single segment 120. Furthermore, each of the segments 120 illustrated in FIGS. 3A-3D are shown having the welding material 110 that can be used to attach the segments 120 to the wheel 102 of the saw blade 100. Although shown as being substantially rectangular, one of ordinary skill in the art will appreciate that the segments 120 can be any shape suitable for the application. For example, the segments 120 can be or include a single or multiple top-notched segment, a single or multiple side-notched segment, a trapezoidal segment, a poly arc segment, a "V" top segment, a roof top segment, a wavy top segment, a round segment, a saddle segment, or any other suitably-shaped segment for the application. The various features of each of the segments 120 illustrated in FIGS. 3A-3D will be described in greater detail herein.

FIG. 3A illustrates a first segment 120A and a second segment 120B, similar to the segments 120 shown and described in relation to FIGS. 1 and 2. As shown, the first segment 120A and the second segment 120B can each have a single first portion 130 and a single second portion 140 which extend along the length of the segment 120. The first portion 130 and the second portion 140 can extend along the length of the segment 120 in a cutting direction of the saw blade 100 or abrasive cutting tool.

FIG. 3B illustrates another example of a first segment 120A and a second segment 120B. Similar to the first and second segments 120A, 120B illustrated in FIG. 3A, the first and second segments 120A, 120B illustrated in FIG. 3B can both have first portions 130 and second portions 140 that extend along the length of the segment 120 in a cutting direction of the saw blade 100 or abrasive cutting tool. Furthermore, the first portions 130 and the second portions 140 of the first and second segments 120A, 120B can be reciprocally arranged in relation to each other. The first and second segments 120A, 120B illustrated in 3B, however, can each have two first portions 130 and two second portions 140 that extend along the length of the segment 120 in a cutting direction of the saw blade 100. In other words, the width of the first portion 130 and the second portion 140 can be reduced to accommodate a greater number of first portions 130 and second portions 140 that are arranged side-by-side on the segments 120. As will be appreciated by one of skill in the art, by having two first portions 130 and two second portions 140 which have a smaller width, the first and second segments 120A, 120B can be configured to remove smaller chips 252 from the cut material 250. By reducing the width of the first portion 130 and the second portion 140, and consequently the size of the chips 252 removed from the cut material 250, the saw blade 100 is able to achieve a smoother cut through the cut material 250. In contrast, by increasing the size of the first portion 130 and the second portion 140 (e.g., as illustrated in FIGS. 1-3A), larger chips 252 can be removed such that the saw blade 100 can be configured to cut faster but will achieve a rougher cut through the cut material 250.

Figure 3E:
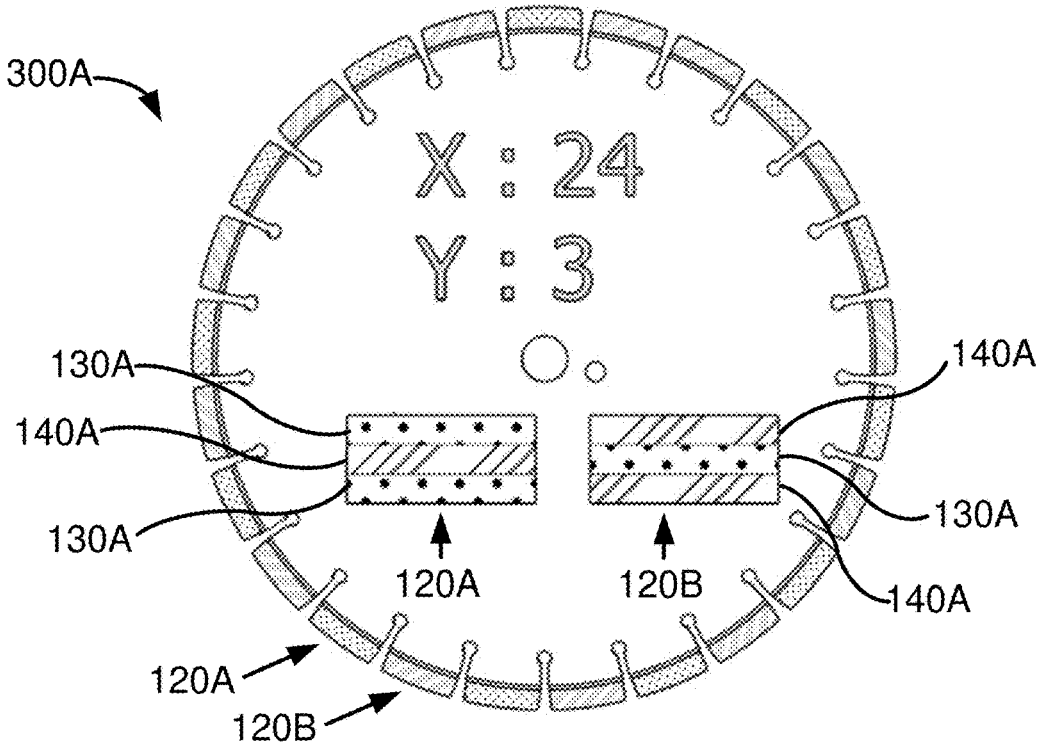
FIGS. 3E-3G illustrate various segment arrangements of the abrasive cutting tool, in accordance with the disclosed technology.
Figure 3F:
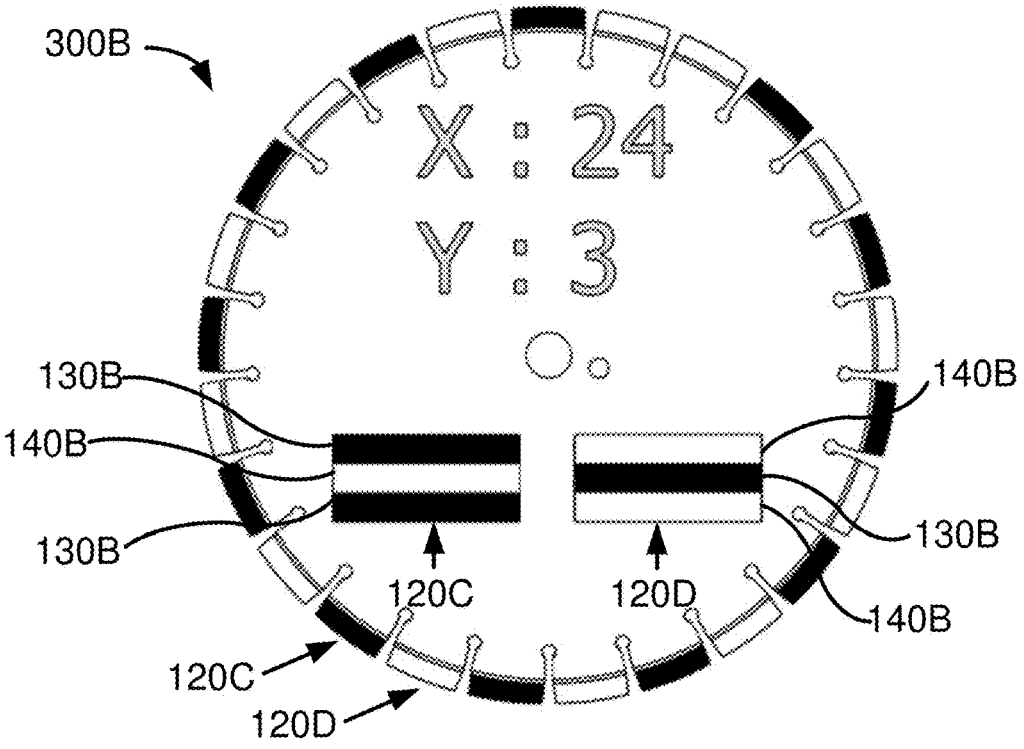
Figure 3G:
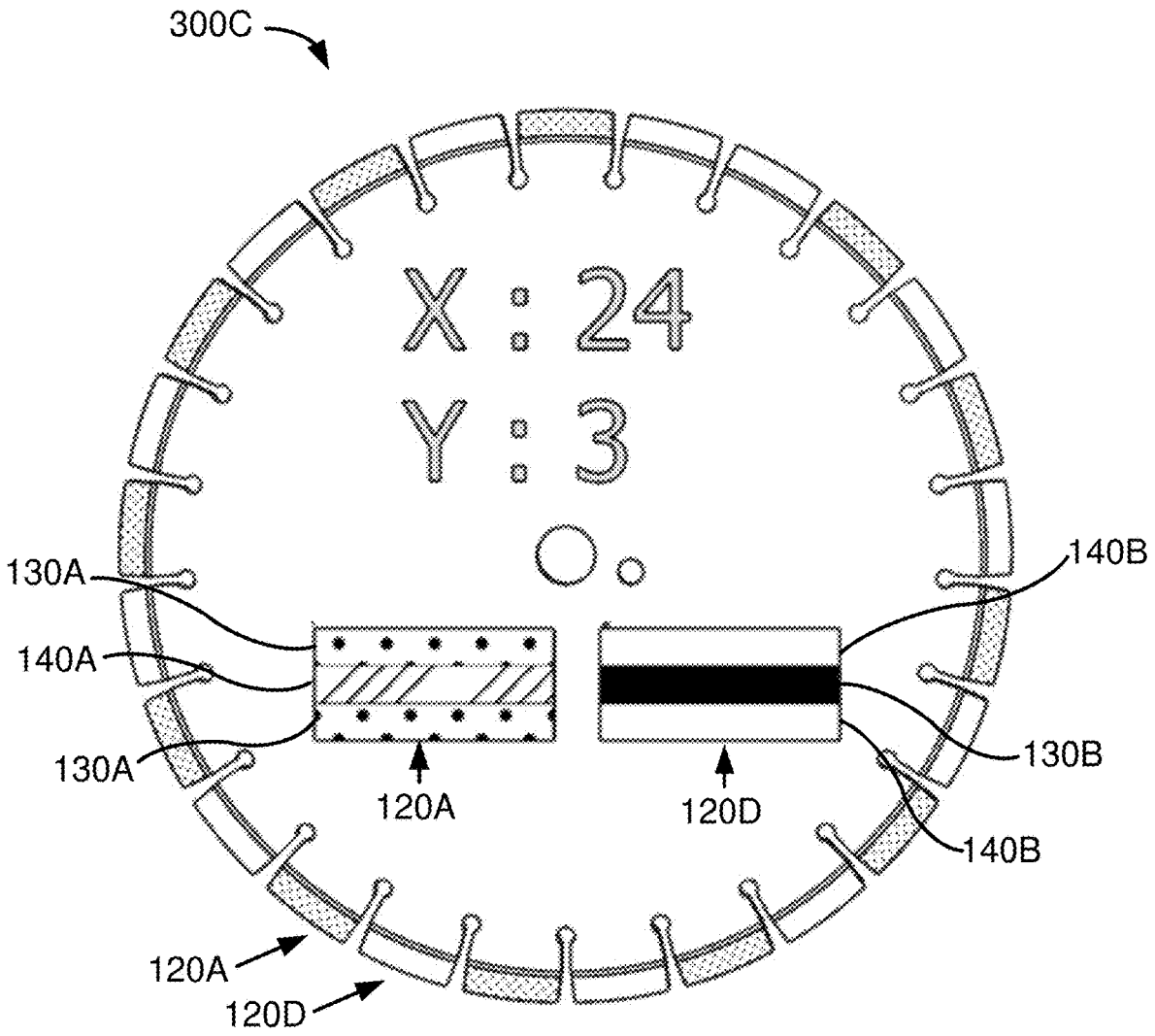

As explained previously, in some examples, the first portion 130 on a first segment 120 may intentionally comprise different material properties (i.e., the material properties of the abrasive material and the matrix material) than a first portion 130 on a second segment 120 (i.e., a "third portion"). Similarly, the second portion 140 on a first segment 120 can intentionally comprise different material properties than a second portion 140 on a second segment 120 (i.e., a "fourth portion"). In doing so, the performance of the saw blade 100 can be tailored to the specific material to be cut and the specific cutting application. FIGS. 3E-3G are offered to help further illustrate this feature. FIG. 3A, illustrates a saw blade 300A having a first segment 120A having two first portions 130A having a first hardness and a second portion 140A having a second hardness. The first hardness can be greater than the second hardness. The saw blade 300A can further include a second segment 120B having one first portion 130A and two second portions 140A. As shown, the first segment 120A and the second segment 120B can be attached to the periphery of the saw blade 300A in a reciprocal arrangement in accordance with the disclosed technology. As a non-limiting example, the saw blade 300A can be configured for applications with a high horsepower saw.

FIG. 3F illustrates a saw blade 300B having a first segment 120C having two first portions 130B ("third portions") having a third hardness and a second portion 140B ("fourth portion") having a fourth hardness. As a non-limiting example, the third hardness can greater than the fourth hardness but less than the second hardness. In other words, if arranged in order of increasing hardness, the portions of saw blade 300A and saw blade 300B would be ordered from second portion 140B, to first portion 130B, to second portion 140A, to first portion 130A. In other examples, the first portion 130B can have a greater hardness than the second portion 140A such, if arranged in order of increasing hardness, the portions of saw blade 300A and saw blade 300B would be ordered from second portion 140B, to second portion 140A, to first portion 130B, to first portion 130A. The saw blade 300B can further include a second segment 120D having one first portion 130B and two second portions 140B. As shown, the first segment 120C and the second segment 120D can attached to the periphery of the saw blade 300B in a reciprocal arrangement. As a non-limiting example, the saw blade 300B can be configured for applications with a low horsepower saw.

FIG. 3G illustrates a saw blade 300C having the first segments 120A with the first portions 130A having a first hardness and second portions 140A having a second hardness attached around the periphery of the saw blade 300C in a reciprocal arrangement with the second segments 120D having the first portions 130B ("third portions") having a third harness and the second portions 140B ("fourth portions") having a fourth hardness. As will be appreciated, by arranging the first segments 120A along with the second segments 120D along the periphery of the saw blade 300C, the saw blade 300C can be configured for applications in which the saw blade 300A and saw blade 300B would be insufficient or improper. For example, the saw blade 300C can be configured for applications with a medium horsepower saw. The saw blade 300A-300C are offered for illustrative purposes and it should be appreciated that the saw blades 300A-300C can be varied according to any of the examples shown and described herein.

Figure 4:
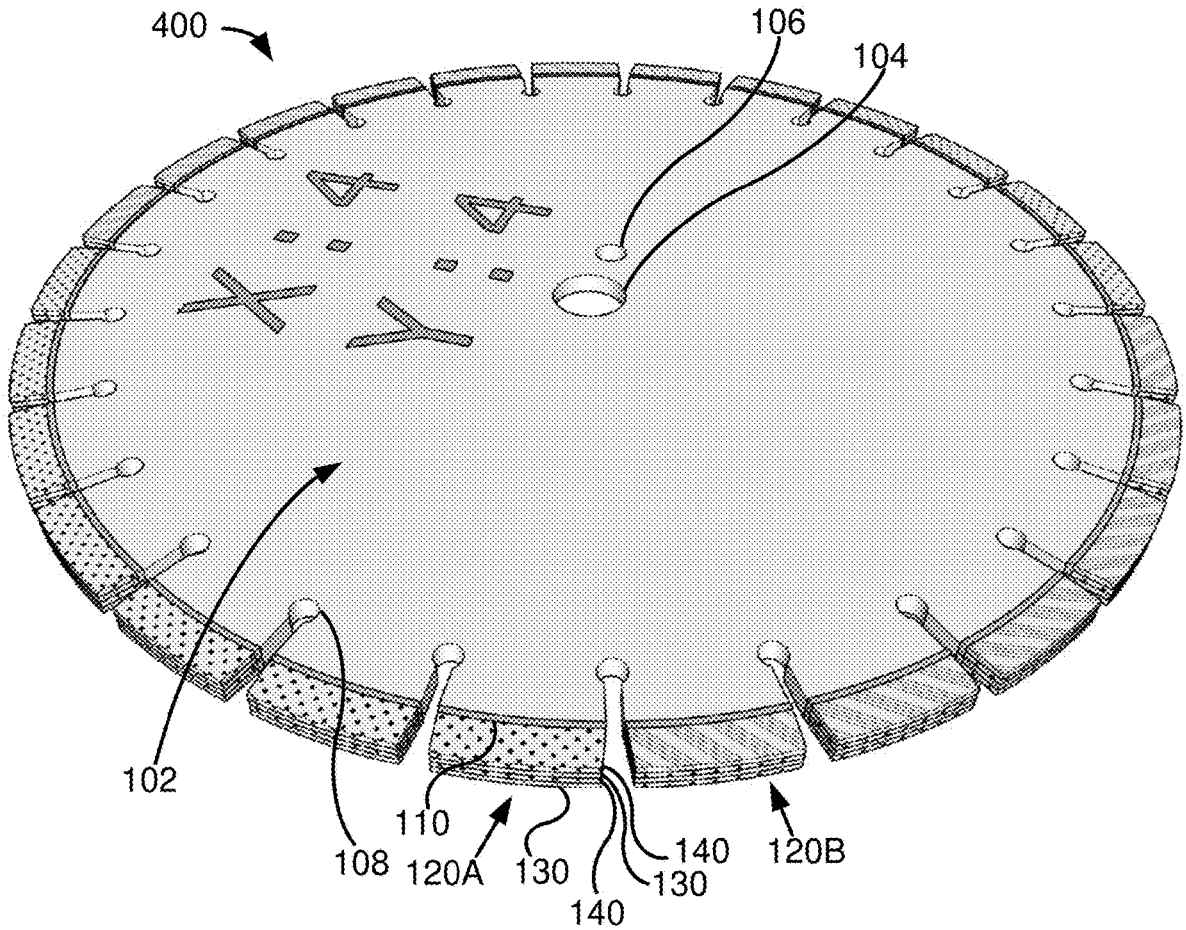
FIGS. 4-6 illustrate perspective views of various examples of cutting tools, in accordance with the disclosed technology.

FIG. 4 illustrates an example saw blade 400 having the first segments 120A and second segments 120B shown and described in relation to FIG. 3B. The first segments 120A and the second segments 120B are illustrated as being attached to the periphery of the saw blade 400 such that the first segments 120A and the second segments 120B alternate about one quarter of the way around the periphery of the saw blade 400 (as opposed to roughly one-half of the saw blade as illustrated in FIG. 1). In other words, the first segments 120A can be attached to the periphery of the saw blade 400 and extend about a quarter of the way around the saw blade 400 before the second segments 120B are attached to the saw blade 400.

In contrast to the segments 120 shown and described in relation to FIGS. 1-3B which each had an even total number of first and second portions 130, 140, FIG. 3C illustrates a first and second segment 120A, 120B having an odd total number of first and second portions 130, 140. As illustrated, the first segment 120A can have a single first portion 130 and two second portions 140 and a second segment 120B can have two first portions 130 and a single second portion 140. The first portions 130 and the second portions 140 of each segment 120A, 120B can extend along the length of the segment 120A, 120B in the cutting direction of the saw blade 100 or abrasive tool. As will be appreciated by one of skill in the art, the arrangement shown in FIG. 3C would have a different wear pattern than the segments 120A and 120B shown in FIG. 3A. For example, the first segment 120A would have a substantially rounded wear pattern due to the first portion 130 (which is harder than the second portion 140) being placed between the two second portions 140. The second segment 120B, however, would have a substantially saddle wear pattern due to the second portion 140 (which is softer than the first portion 130) being placed between two first portions 130. Thus, the segments 120A and 120B shown in FIG. 3C would be configured to create chips 252 in the kerf 258 which would alternate between being in a middle portion of the kerf 258 and the outer portions of the kerf 258 depending on which segment 120 passes through the cut material 250. Furthermore, as will be appreciated, by having three total first and/or second portions 130, 140, the segments 120A, 120B will be configured to remove chips 252 that would be smaller than the chips 252 removed by the segments 120A, 120B shown in FIG. 3A but larger than the chips 252 removed by the segments 120A, 120B shown in FIG. 3B.

Figure 5:
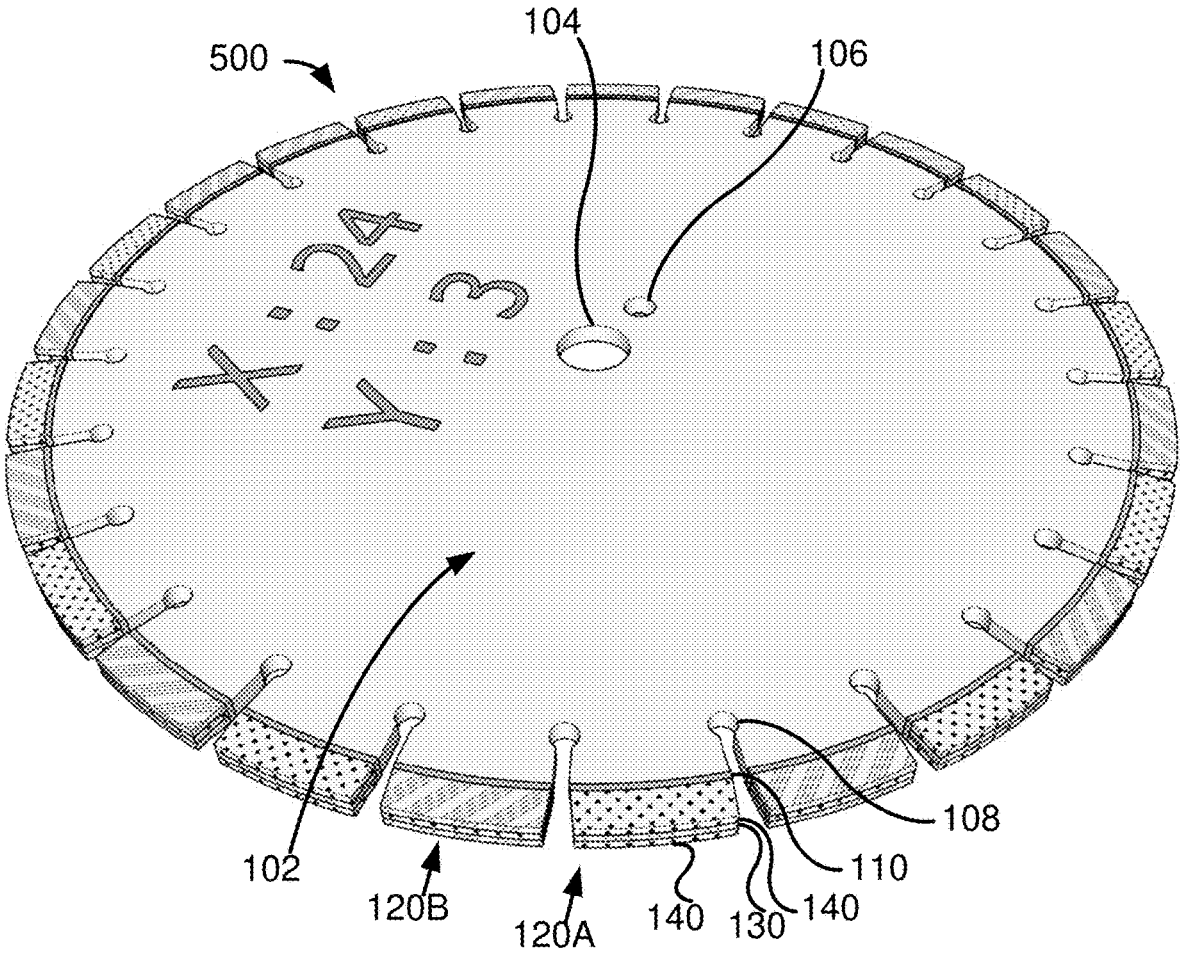

FIG. 5 illustrates an example saw blade 500 having the segments 120A, 120B shown and described in relation to FIG. 3C. As illustrated, the saw blade 500 can have the segments 120A, 120B attached to the periphery of the wheel 102 in an alternating pattern. Thus, each first segment 120A can be adjacent a second segment 120B. Depending on the total number of segments 120 around the periphery of the wheel 102, some first segments 120A may be adjacent another first segment 120A and/or some second segments 120B may be adjacent another second segment 120B as shown in FIG. 3C. For example, the saw blade 500 has a total of twenty-five segments and necessarily has at least one first segment 120A adjacent another first segment 120A and/or at least one second segment 120B adjacent another second segment 120B.

FIG. 3D illustrates another segment 120 having a plurality of first portions 130 and a plurality of second portions 140. Unlike the segments 120 previously described herein, the segment 120 illustrated in FIG. 3D has multiple first segments 130 and multiple second segments 140 that are reciprocally arranged along the length of the segment 120. In other words, rather than reciprocally arranging the first portions 130 and the second portions 140 between each segment 120, the first and second portions 130, 140 can be reciprocally arranged along the length of the segment 120 itself. Furthermore, rather than extending along the length of the segment 120 in a cut direction of the saw blade 100, the first and second portions 130, 140 can extend along a portion of the length of the segment 120. To illustrate, the segment shown in FIG. 3D has at least two first portions 130 and at least two second portions 140 along the length of the segment 120 in the cut direction of the saw blade 100. Furthermore, similar to the segments 120 described in relation to FIGS. 1-3C, the first and second portions 130, 140 can be alternated in a width direction of the segment 120. In the example shown in FIG. 3D, the segment 120 only has a single first portion 130 and a single second portion 140 in a width direction of the segment. One of skill in the art, however, will appreciate that the segment 120 can have multiple first portions and second portions 130, 140 in the width direction of the segment.

As will be appreciated by one of skill in the art, because the segment 120 shown in FIG. 3D has a plurality of first portions and second portions 130, 140 that are reciprocally arranged along the segment 120 in a cut direction of the saw blade 600, the segment 120 can be configured to create smaller chips 252 when cutting the cut material 250. In other words, even though the width of the first portions and second portions 130, 140 may be the same as, or similar to, the segments 120A, 120B shown and described in relation to FIG. 3A, the first and second portions 130, 140 are shorter in a cut direction of the saw blade 600. Because the first and second portions 130, 140 are shorter, there is less distance between the harder first portions 130 and therefore less wear in the second portions 140 between each first portion 130 as the segment 120 passes through the cut material 250. In this way, the segments 120 illustrated in FIG. 3D can help to achieve a smoother cut through the cut material 250.

Figure 6:
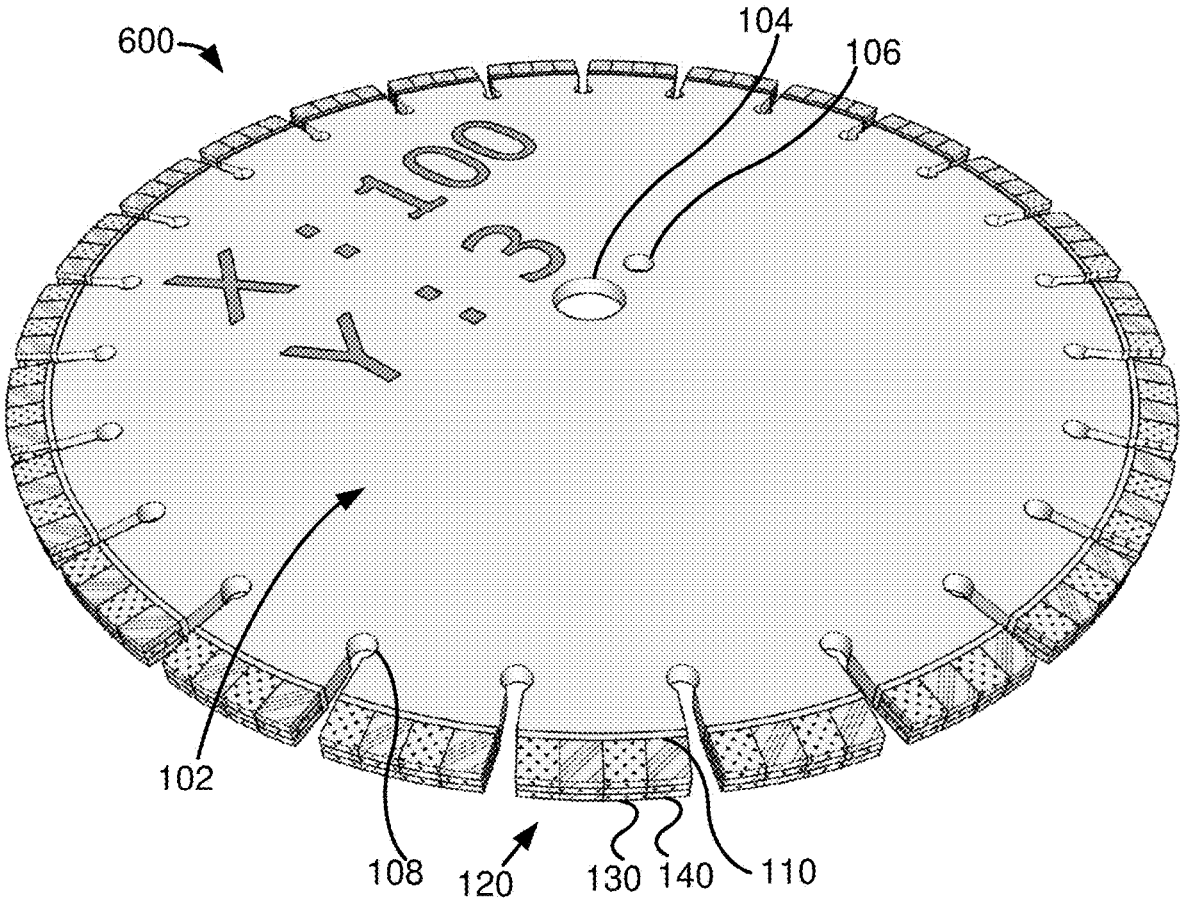

FIG. 6 illustrates an example saw blade 600 having segments 120 similar to the segments shown and described in relation to FIG. 3D. The segments 120 illustrated in FIG. 6, however, can have three layers of first portions and/or second portions 130, 140 in a width direction of the segment 120 (instead of two layers as shown in FIG. 3D). As illustrated in FIG. 6, because the segments 120 have a plurality of first portions and second portions 130, 140 that are reciprocally arranged extending along the length of the segment 120 in a cutting direction of the saw blade 600, the segments can each be adjacent a similar segment 120. In other words, each segment 120 attached to the periphery of the saw blade 600 can have the same or similar configuration.

Figure 7:
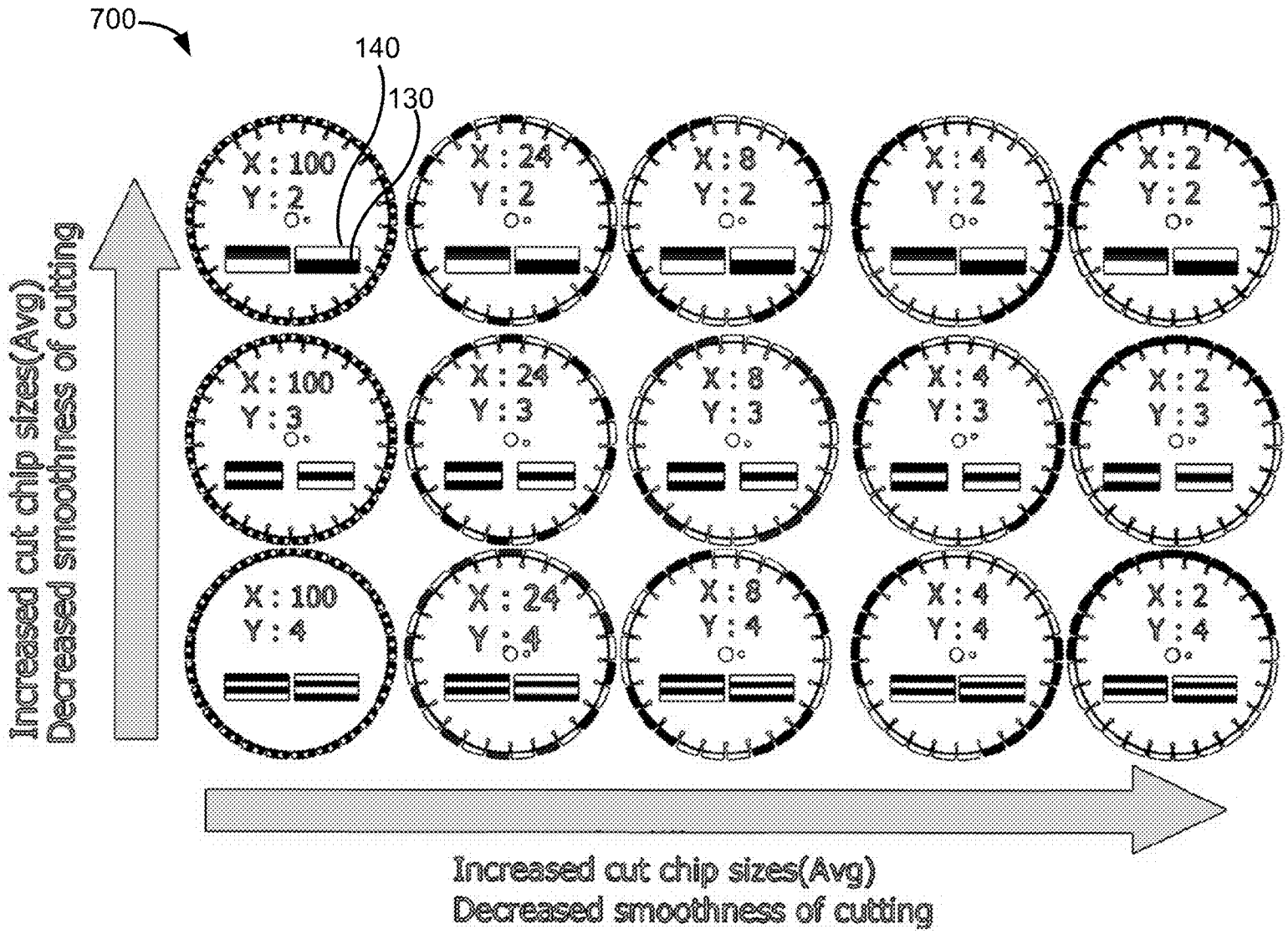
FIG. 7 illustrates a table showing various configurations of cutting tools, in accordance with the disclosed technology.

FIG. 7 illustrates a table 700 showing various configurations of abrasive cutting tools (e.g., saw blades 100), in accordance with the disclosed technology. The table 700 illustrates the relation between the number of first and second portions 130, 140 (shown on the front of each saw blade 100) in a width direction of the segment (the "Y" value in the table 700) and the number of alternating first and second portions 130, 140 along the periphery of the saw blade 100 in a cut direction of the saw blade 100 (the "X" value in the table 700). For example, starting at the top right corner of the table 700, the saw blade 100 of FIG. 1 is depicted. As illustrated, the saw blade 100 of FIG. 1 has two total layers ("X:2") of first and second portions 130, 140 (e.g., one first portion 130 and one second portion 140) in the width direction of saw blade 100 and two total alternating sections of segments 120 ("Y:2") along the periphery of the saw blade 100 in the cut direction of the blade 100. In other words, the segments 120 are arranged in a first orientation for approximately half of the circumference of the saw blade 100 and in a second orientation for approximately the other half of the circumference of the saw blade 100. This configuration is likely to result in relatively large chip 252 sizes and achieve a relatively rough cut.

To illustrate further, the saw blade 100 in the bottom left corner of the table 700 is configured to create comparatively small chip 252 sizes and achieve a comparatively smoother cut. As shown, the saw blade 100 in the bottom left corner of the table 700 comprises segments 120 having four layers of alternating first and second portions 130, 140 in a width direction of the segment 120 ("Y:4") and one hundred alternating first and second portions 130, 140 along the outer circumference of the saw blade 100 in a cut direction of the saw blade 100 ("X:100"). In other words, because the saw blade 100 has twenty-five total segments 120 around the outer circumference of the saw blade 100, and each segment 120 has a total of four layers of alternating first and second portions 130, 140, the total number of alternating first and second portions 130, 140 is equal to one hundred (e.g., four layers for each segment 120 multiplied by twenty-five segments).

As depicted in the table 700, the saw blades 100 can be categorized by the number of layers of first and second portions 130, 140 in a width direction of the segment 120 ("Y") and by the number of alternating first and second portions 130, 140 along the periphery of the saw blade 100 in a cut direction of the saw blade 100 ("X"). As will be appreciated by one of ordinary skill in the art, the number of layers of first and second portions 130, 140 in a width direction of the segment 120 ("Y") is not limited to the examples shown in table 700 and can include any number of layers in a width direction. Similarly, the number of alternating first and second portions 130, 140 along the periphery of the saw blade 100 in a cut direction of the saw blade 100 ("X") is not limited to the examples shown in table 700 and can include any number of alternating first and second portions 130, 140 along the periphery of the saw blade 100. As the number of first and second portions 130, 140 in a width direction increase (i.e., as Y is increased), the size of the chips 252 will decrease and the overall smoothness of the cut will increase (and vice versa). Similarly, as the number of first and second portions 130, 140 that are alternated along the outer circumference of the saw blade 100 increase (i.e., as X is increased), the length of the first and second portions 130, 140 will decrease, the size of the chips 252 will decrease, and the overall smoothness of the cut will increase. The opposite is also true as the number of first and second portions 130, 140 that are alternated along the outer circumference of the saw blade 100 decreases (e.g., the size of the chip and the roughness of the cut will increase with a decreasing number of alternating first and second portions 130, 140).

Although each of the segments 120 shown in the figures and described herein have first portions and second portions 130, 140 of the same or similar width and length along the segment 120, it will be appreciated that the first portions and second portions 130 can have varying lengths and widths along the segment 120. That is, a segment 120 can have first portions 130 that are longer or shorter and wider or narrower than the second portions 140, and vice versa. Furthermore, a segment 120 can have a first portion 130 that is longer or shorter and/or wider or narrower than another first portion 130 on the same segment and/or a second portion 140 that is longer or shorter and/or wider or narrower than another second portion 140 on the same segment. Thus, one of skill in the art will appreciate that the lengths, widths, and configurations of the first portions 130 and second portions 140 can be varied depending on the particular configuration and application.

Figure 8:
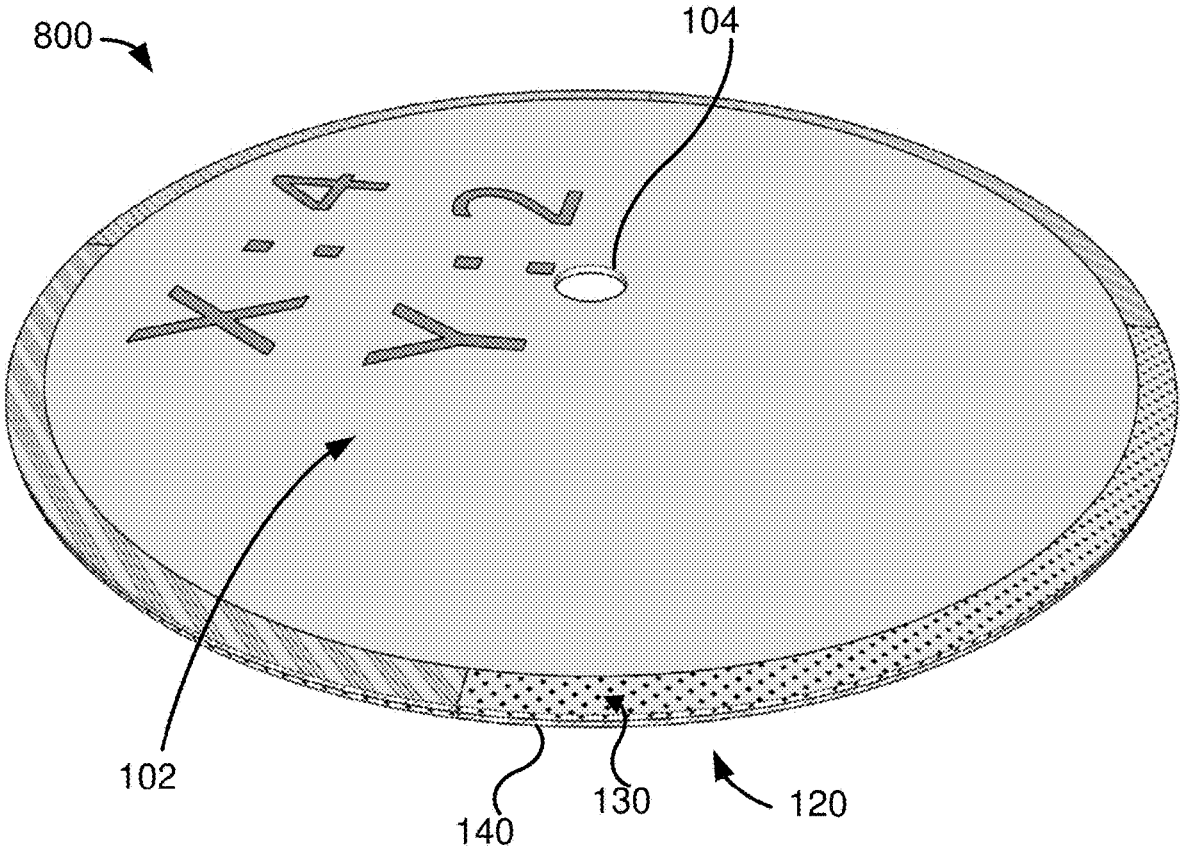
FIG. 8 illustrates a perspective view of an abrasive cutting tool, in accordance with the disclosed technology.

FIG. 8 illustrates a saw blade 800 having segments 120 which extend continuously along the periphery of the wheel 102. As will be appreciated, the saw blade 800 can be similar to the saw blade 100, however, the segments 120 are not separated by a gap (e.g., gullet 108). In this way, the saw blade 800 can be configured for applications wherein a saw blade 800 having segments 120 extending continuously along the periphery of the wheel 102 would perform better than saw blade 100 having gullets 108 (e.g., cutting metals). Similar to the saw blade 100, the segments 120 of the saw blade 800 can be reciprocally arranged around the periphery of the wheel 102. Furthermore, the segments 120 may be attached to the wheel 102 with a welding material 110 or be directly bonded to the periphery of the wheel 102.

FIGS. 9A-9G illustrate various examples of cutting tools in accordance with the disclosed technology. The examples of cutting tools illustrated in FIGS. 9A-9G can include segments 120 having the various features and configurations described herein. Thus, FIGS. 9A-9G are not limited to the particular examples shown and described herein but can be modified to be or include each of the features described throughout this disclosure.

Figure 9A:
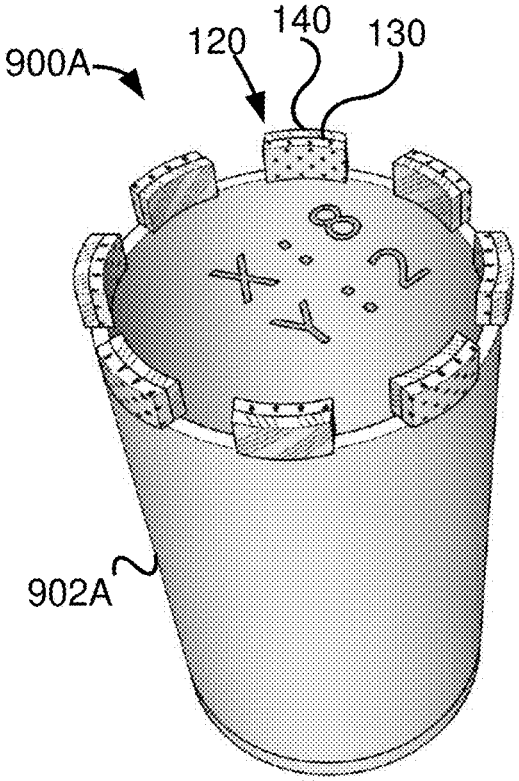
FIGS. 9A-9G illustrate various examples of cutting tools, in accordance with the disclosed technology.

FIG. 9A illustrates a core drilling bit 900A with segments 120 attached to a bottom surface of a bit 902A. Similar to the saw blade 100, the core drilling bit 900A can have the segments 120 attached to the outer periphery of the bit 902A to facilitate cutting of a cut material 250. As will be appreciated, the core drilling bit 900A can be configured to be rotated to cut a cut material 250 to drill out a core of the cut material 250. Although the segments 120 illustrated in FIG. 9A include just a single first portion 130 and a single second portion 140, the segments 120 can be or include any of the segments 120 described herein. Furthermore, although the segments 120 are shown as alternating every other segment 120 around the core drill bit 900A, the segments 120 can be arranged in any of the configurations described herein.

Figure 9B:
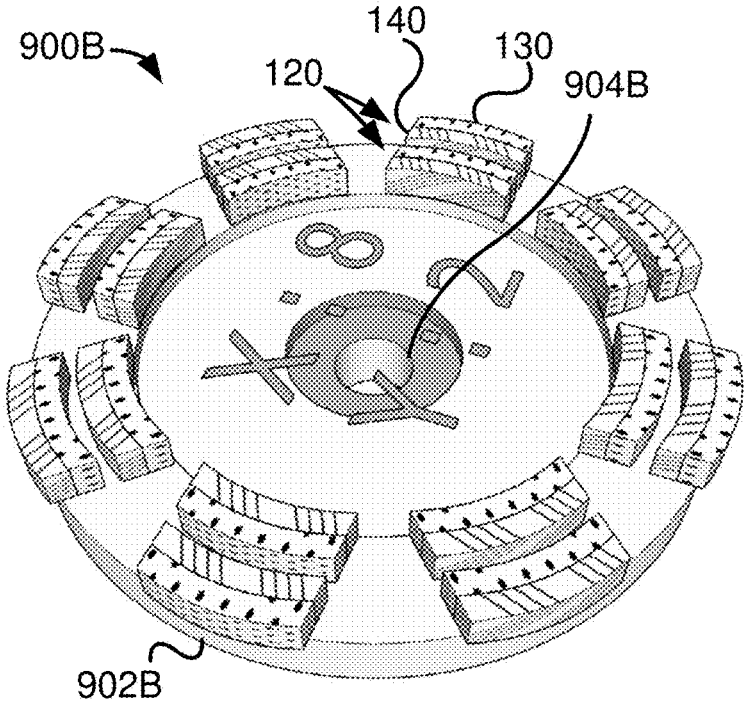

FIG. 9B illustrates a grinding wheel 900B with segments 120 attached to a bottom surface of a wheel 902B. Similar to the saw blade 100, the grinding wheel 900B can have the segments 120 attached to the bottom surface of the wheel 902B to facilitate cutting of a cut material 250. As will be appreciated, the grinding wheel 900B can be configured to be rotated to grind or cut a cut material 250. Although the segments 120 illustrated in FIG. 9B include just a single first portion 130 and a single second portion 140, the segments 120 can be or include any of the segments 120 described herein. Furthermore, although the segments 120 are shown as alternating every other segment 120 around the grinding wheel 900B, the segments 120 can be arranged in any of the configurations described herein.

Figure 9C:
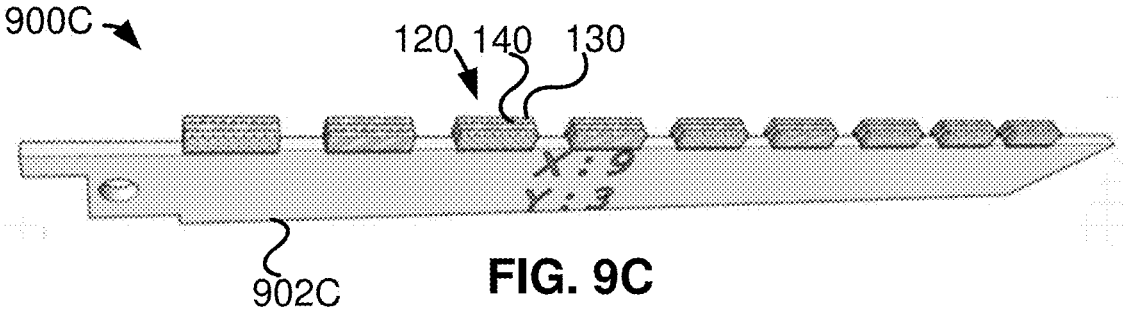

FIG. 9C illustrates a reciprocating saw blade 900C having segments 120 attached to a an outer periphery of the reciprocating saw blade 900C. The reciprocating saw blade 900C can have segments 120 attached to a blade 902C. As will be appreciated by one of skill in the art, unlike the saw blade 100, the core drilling bit 900A, and the grinding wheel 900B, the reciprocating saw blade 900C is not rotated around an axis but is moved in a first direction and in a second direction that is approximately opposite the first direction to facilitate cutting of a cut material 250. The segments 120 illustrated in FIG. 9A can be or include any of the segments 120 described herein. Furthermore, although the segments 120 are shown as alternating every other segment 120 around the reciprocating saw blade 900C, the segments 120 can be arranged in any of the configurations described herein.

Figure 9D:
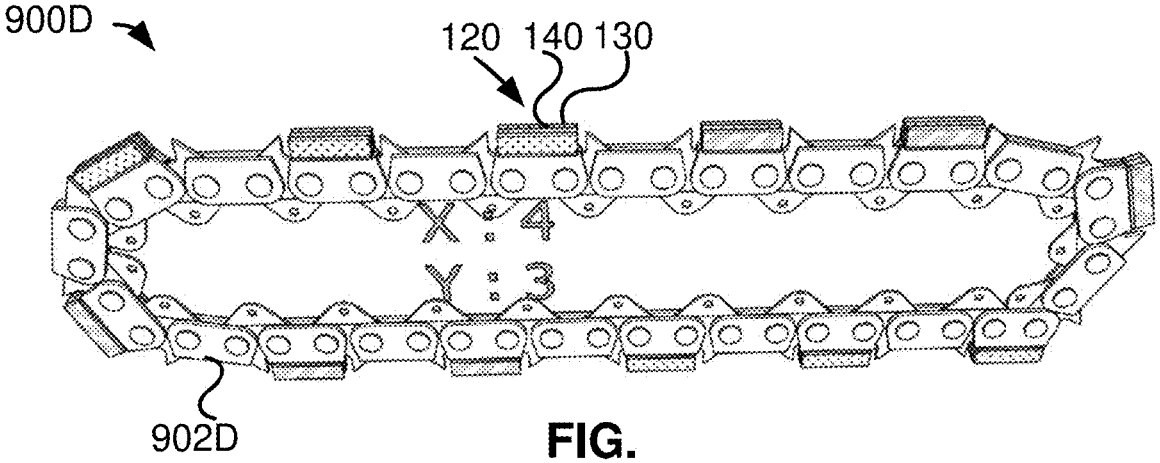

FIG. 9D illustrates a chain saw blade 900D having segments 120 attached to an outer periphery of the chain saw blade 900D. As will be appreciated by one of skill in the art, similar to a chain saw used for cutting wood, the chain saw blade 900D can be rotated (or pulled) around a bar 902D to facilitate cutting of a cut material 250. The segments 120 illustrated in FIG. 9D can be or include any of the segments 120 described herein. Furthermore, the segments 120 can be arranged in any of the configurations described herein.

Figure 9E:
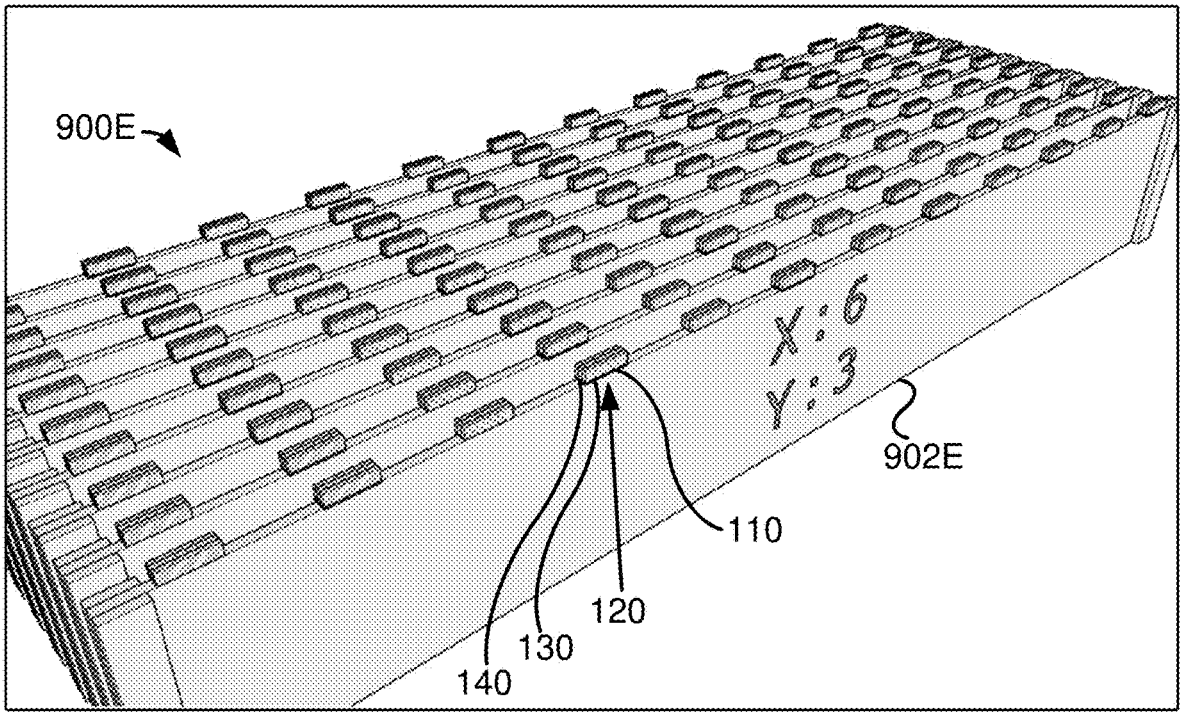

FIG. 9E illustrates a gang saw 900E having segments 120 attached to an outer periphery of the blades 902E of the gang saw 900E. As will be appreciated by one of skill in the art, similar to existing gang saws, the gang saw 900E can have multiple blades 902E with segments 120 attached to each of the blades 902E to facilitate making multiple cuts simultaneously through a cut material 250. The segments 120 illustrated in FIG. 9E can be or include any of the segments 120 described herein and can be arranged in any of the configurations described herein.

Figure 9F:
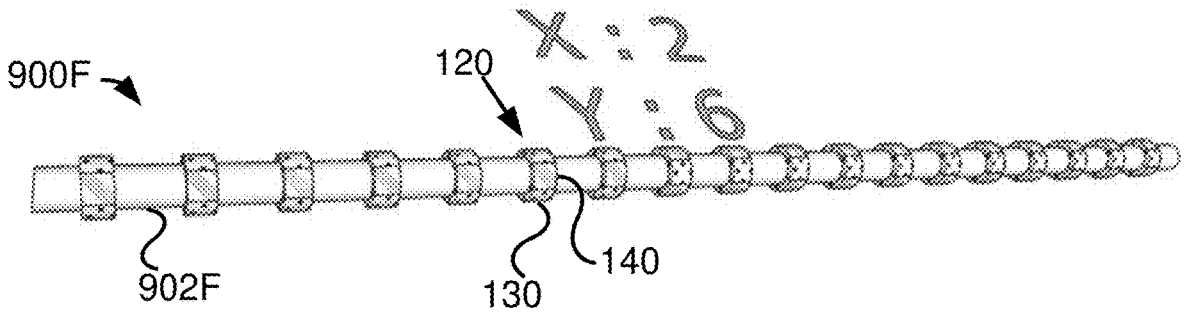
Figure 9G:
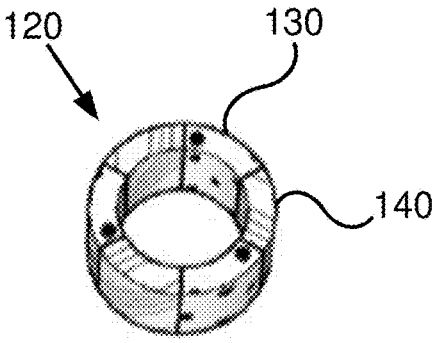

FIG. 9F illustrates a wire saw 900F having segments 120 attached to an outer periphery of the wire 902F while FIG. 9G illustrates a detail view of a segment 120 of the wire saw 900F. The wire saw 900F can have multiple segments 120 that can be reciprocally arranged along the wire 902F to facilitate cutting of a cut material 250. The segments 120 illustrated in FIG. 9F can be or include any of the segments 120 described herein and can be arranged in any of the configurations described herein.

The examples shown and described in relation to FIGS. 9A-9G are offered as illustrative examples of applications of the disclosed technology, but one of skill in the art will appreciate that the disclosed technology can be applied to other types of abrasive cutting tools such as band saws, cutting discs, lapping tables, polishing machines, sanding machines, routers, planers, jointers, or any other suitable application.

Figure 10:
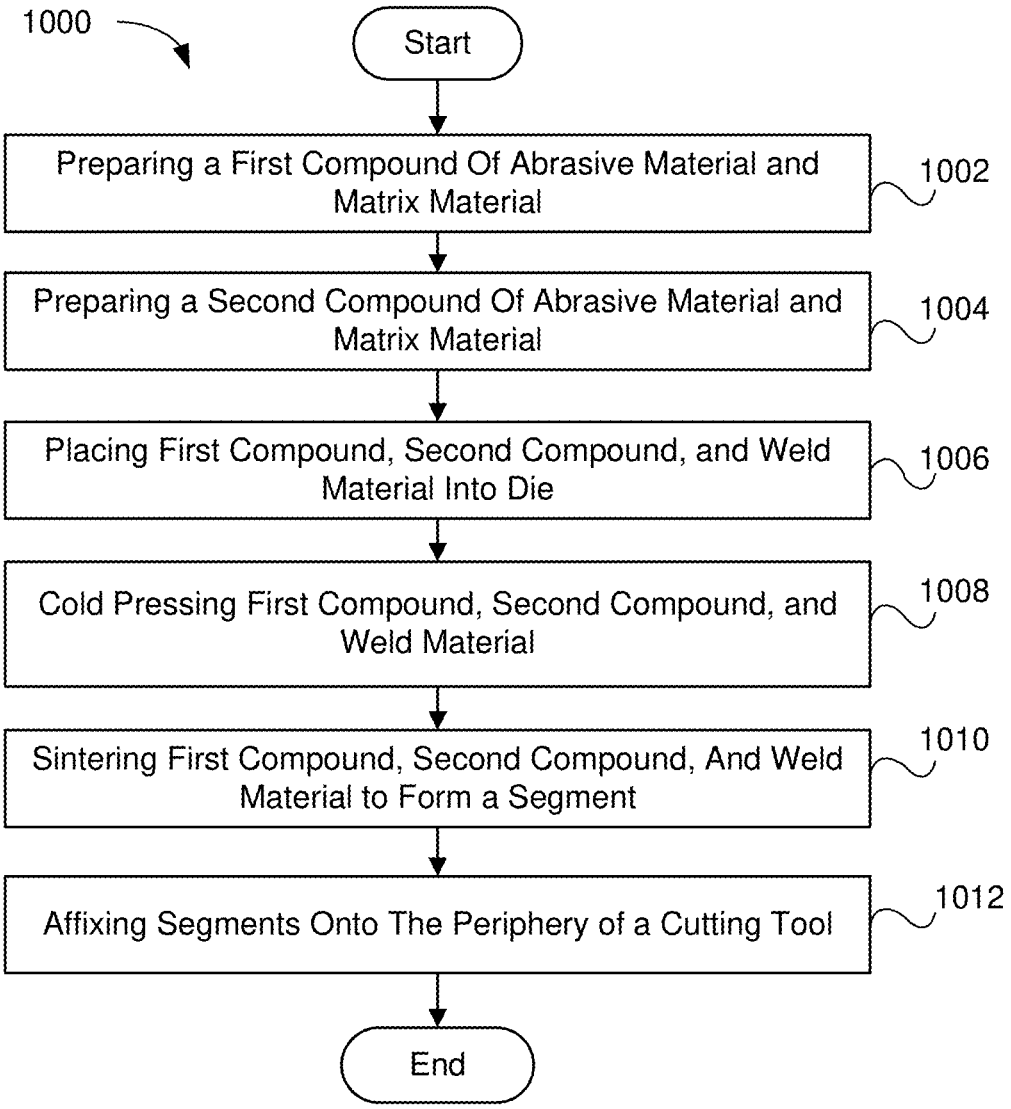
FIG. 10 illustrates a flow chart of a method of manufacturing an abrasive cutting tool, in accordance with the disclosed technology.

FIG. 10 illustrates a flow chart of a method 1000 of manufacturing a saw blade 100, in accordance with the disclosed technology. FIGS. 11-14 illustrate various steps, features, or processes of the method 1000 and reference will be made to such figures while describing the method 1000. Although the method 1000 is described in relation to manufacturing a saw blade 100, one of skill in the art will appreciate that the method 1000 can be applied to manufacturing any of the abrasive cutting tools described herein. Thus, the methods shown and described herein should not be construed as being limited to the particular application described herein.

The method 1000 of manufacturing a saw blade 100 can include preparing 1002 a first compound of abrasive material and matrix material. The method 1000 can include preparing 1004 a second compound of abrasive material and matrix material. The first compound of abrasive material can include a higher concentration of abrasive material than the second compound to create the first portion 130 of the segment 120. Furthermore, the second compound can have a lower concentration of abrasive material than the first compound to create the second portion 140 of the segment 120. As will be appreciated, although described herein in the context of a single segment 120 (e.g., a first compound and a second compound), one of skill in the art will appreciate that the same or similar processes can be used to manufacture a second segment or any number of segments 120 (e.g., a third compound and a fourth compound and so forth) for the abrasive cutting tool as necessary. Each segment 120 can have a first portion 130 and a second portion 140 having the same or similar concentration of abrasive material as the first portion 130 (first compound) and second portion 140 (second compound) described herein.

The method 1000 can further include placing 1006 the first compound, second compound, and a weld material into a die and then cold pressing 1008 the first compound, second compound, and weld material together in the die. Cold pressing 1008 the first compound, second compound, and weld material together in the die can create a hardened shape that can then be sintered 1010 to create the segment 120. The segments 120 can then be attached to the periphery of a cutting tool (e.g., saw blade 100) to create an abrasive cutting tool according to the disclosed technology.

The abrasive material can be any suitable abrasive material for the application, including diamond, polycrystalline diamond, cobalt, tungsten carbide, cubic boron nitride, calcite, emery, novaculite, pumice, corundum, garnet, staurolite, iron oxide, sand, sandstone, powdered feldspar, Borazon, ceramic material, aluminum oxide, glass, steel abrasive, silicon carbide, slag, or any other suitable abrasive material. Furthermore, the matrix material can be any suitable type of matrix material for the application such as a metal-, polymer-, ceramic-, or resin-based matrix. For example, the matrix material can be or include an aluminum-based metal matrix, magnesium-based metal matrix, titanium-based metal matrix, copper-based metal matrix, super alloy-based metal matrix, epoxy, or any other suitable type of matrix material for the application. Furthermore, as will be appreciated by one of skill in the art, there are several methods which can be used to ensure the first portion 130 is harder or more durable than the second portion 140. As previously described, the first portion 130 can generally comprise a higher concentration of abrasive material than the second portion 140 such that the first portion 130 can be configured to wear more slowly than the second portion 140 when the segment 120 is used to cut or grind a cut material 250. Alternatively, or in addition, the first portion 130 can comprise abrasive material that is larger, harder, of a higher quality, a different type, more densely packed, suspended in a harder matrix (e.g., a matrix that has a higher hardness, a higher strength, a higher density, a high wear resistance, etc.), or any other method that can help to ensure the first portion 130 wears more slowly than the second portion 140 when the segment 120 is used to cut a cut material 250.

Figure 11:
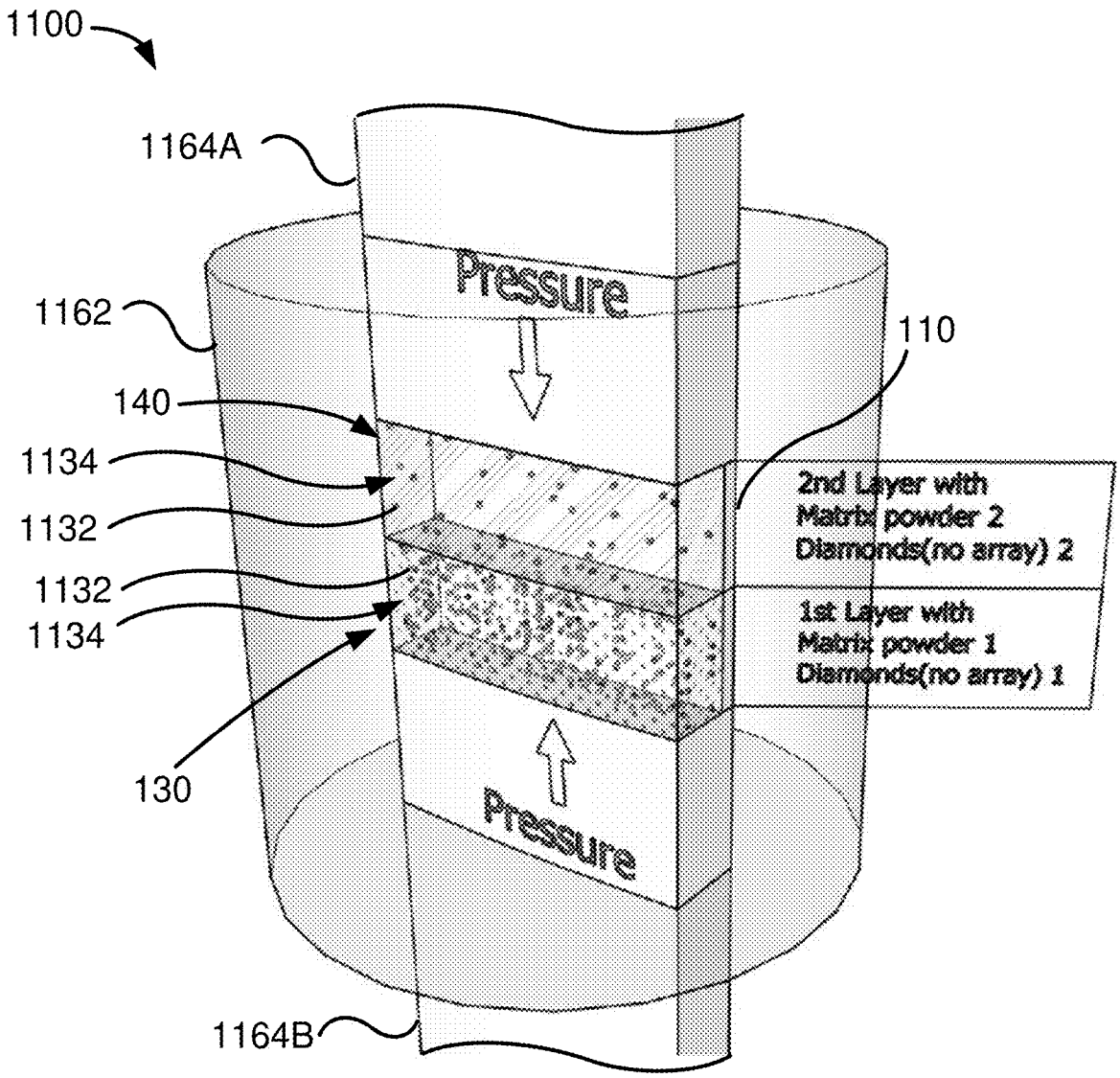
FIG. 11 illustrates a first portion and a second portion of a segment of a cutting tool being cold pressed, in accordance with the disclosed technology.

FIG. 11 illustrates an example of cold pressing 1008 the first portion and the second portion in a die 1162 by a first punch 1164A and a second punch 1164B. As illustrated in FIG. 11, the first compound (e.g., first portion 130) can include a plurality of pieces of abrasive material 1132 that can be randomly dispersed and suspended in a matrix material 1134. Similarly, the second compound (e.g., second portion 140) can include a plurality of pieces of abrasive material 1132 that can be randomly dispersed and suspended in a matrix material 1144, albeit at a lesser concentration than the first compound. The first compound and the second compound can be placed together with a weld material 110 in a die 1162 and then cold pressed 1008 by a first punch 1164A and a second punch 1164B to form a hardened shape.

As will be appreciated by one of skill in the art, FIG. 11 shows a segment 120 having a single first portion 130 and a single second portion 140, but the method 1000 can include segments 120 having a plurality of first portions 130 and a plurality of second portions 140. Each of the first portions 130 and the second portions 140 can be individually pressed before being placed together in the die 1162 to form the hardened shape. Alternatively, or in addition, a first and/or second portion 130, 140 can be cold pressed 1008 first and then additional first and/or second portions 130, 140 can be individually added to the die 1162 and pressed together with the first and/or second portion 130, 140. In this way, each layer of the segment 120 can be individually added and cold pressed 1008 as the segment 120 is formed. Furthermore, as will be appreciated, the number and placement of the first and second portions 130, 140 can be varied according to any of the examples shown and described within this disclosure.

Figure 12A:
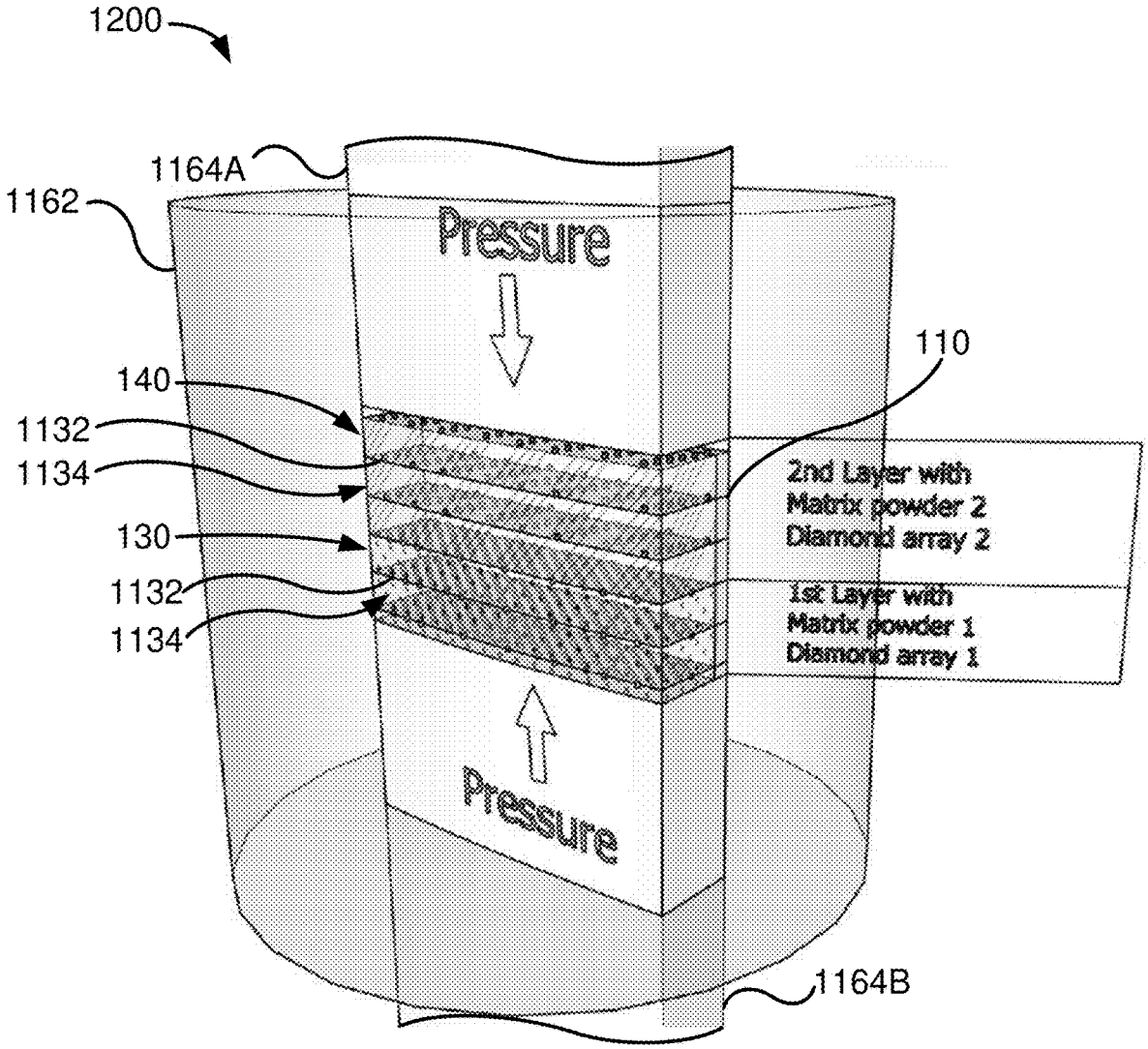
FIG. 12A illustrates another example of a first portion and a second portion of a segment of a cutting tool being cold pressed, in accordance with the disclosed technology.
Figure 12B:
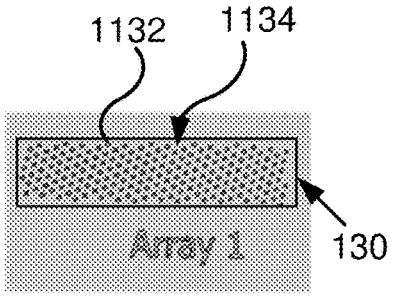
FIGS. 12B-12C illustrate various arrays of abrasive material suspended in a matrix, in accordance with the disclosed technology.
Figure 12C:
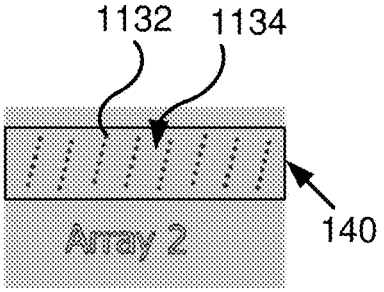

FIGS. 12A-12C illustrate another example of placing 1006 a first compound, a second compound, and a weld material together in a die 1162 and then cold pressing 1008 the first compound, the second compound, and weld material 110 together with a first punch 1164A and a second punch 1164B. Unlike the example illustrated in FIG. 11 in which the abrasive material 1132 is randomly dispersed, however, the abrasive material 1132 shown in FIGS. 12A-12C can be arranged in an array in the matrix material 1134. As illustrated in FIG. 12B, the first compound (i.e., the first portion 130) can include a plurality of pieces of abrasive material 1132 that can be placed in an array suspended in a matrix material 1134 with the abrasive material 1132 being spaced a first distance in any direction from each other. In contrast, as illustrated in FIG. 12C, the second compound (i.e., the second portion 140) can include a plurality of pieces of abrasive material 1132 that can be placed in an array suspended in a matrix material 1134 with the abrasive material 1132 being spaced a second distance in any direction from each other. The second distance can be greater than the first distance to cause the second portion 140 to have a lower concentration of abrasive material 1132 compared to the concentration of abrasive material 1132 of the first portion 130.

Figure 13:
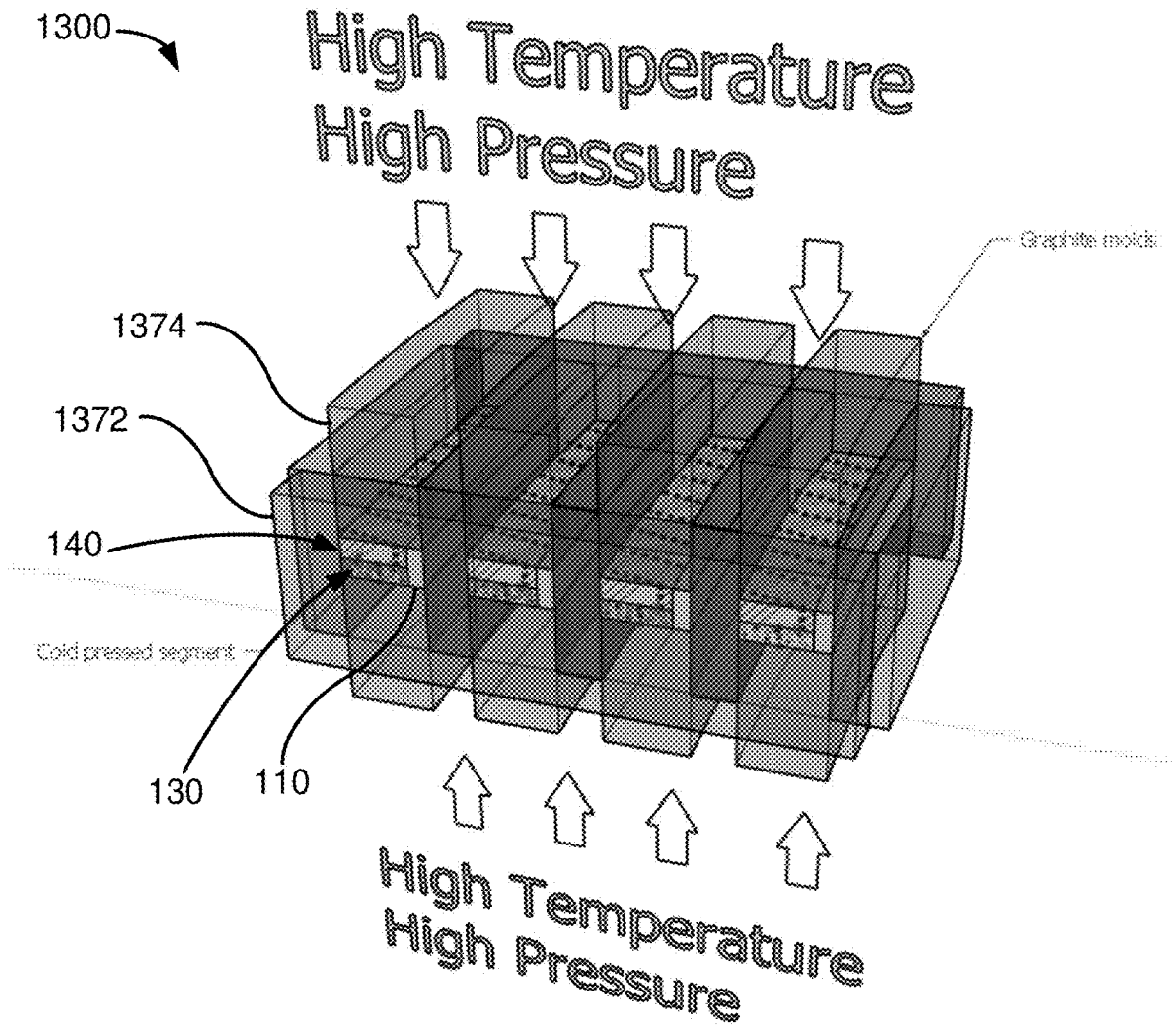
FIG. 13 illustrates various first portions and second portions of segments of a cutting tool being sintered, in accordance with the disclosed technology.

As illustrated in FIG. 13, once the first portion 130, the second portion 140, and the weld material 110 have been cold pressed, the first portion 130, the second portion 140, and the weld material 110 can be sintered 1010 to form the segment 120. The sintering 1010 process can include applying a high pressure and temperature to the first portion 130, the second portion 140, and the weld material 110 by a mold 1372 (e.g., a graphite mold) and a punch 1374 (e.g., a graphite punch). As shown, the mold 1372 and punch 1374 can be configured to sinter several segments 120 at a single time. As will be appreciated by one of skill in the art, sintering 1010 the first portion 130, the second portion 140, and the weld material 110 can cause the first portion 130, the second portion 140, and the weld material 110 (which each generally consist of a powder material) to coalesce into a solid to form the segment 120. The amount of pressure and heat added to the first portion 130, the second portion 140, and the weld material 110 can be varied depending on the materials used to form the segment 120, the size of the segment 120, and the desired hardness to be achieved. In some examples, the first portion 130, the second portion 140, and the weld material can be heated to a temperature between 400° C. and 1100° C. and exposed to a pressure between 250 kg/cm$^2$ and 400 kg/cm$^2$.

Figure 14:
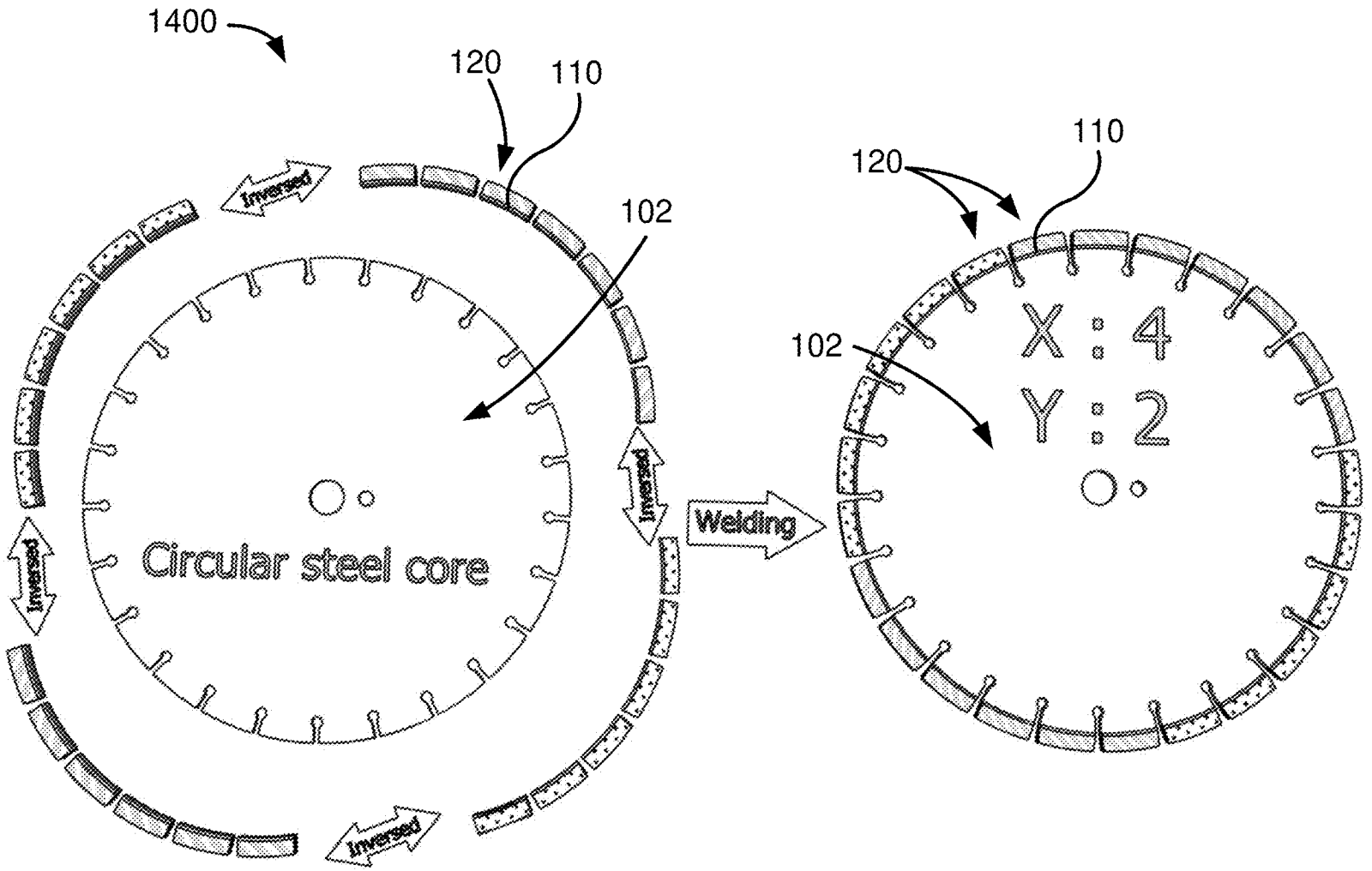
FIG. 14 illustrates segments being affixed to the cutting tool, in accordance with the disclosed technology.

FIG. 14 illustrates segments 120 being affixed to the cutting tool (e.g., the saw blade 100), in accordance with the disclosed technology. As illustrated, once the segments 120 have been formed by cold pressing 1108 and sintering 1010 the first portion 130, second portion 140, and weld material 110, the segments 120 can be attached to the periphery of a cutting tool to form the abrasive cutting tool (e.g., the wheel 102 of the saw blade 100). The segments 120 can be attached to the periphery of the wheel 102 of the saw blade 100 in any of the configurations shown and described within this disclosure. As a specific and non-limiting illustrative example shown in FIG. 14, the segments 120 may comprise segments having a single first portion 130 and a single second portion 140 and be reciprocally arranged around the periphery of the wheel 102 such that the orientation of the segments 120 is alternated about one quarter of the way around the periphery of the wheel 102.

The segments 120 can be attached to the periphery of the wheel 102 using any suitable attachment method. For example, the segments 120 can be soldered, welded, laser welded, sintered, brazed, or any other suitable attachment method to secure the segments 120 to the periphery of the wheel 102. Furthermore, although many of the examples shown and described herein describe the segments 120 as including weld material 110, the segments 120 can be attached to the periphery of the wheel 102 without using weld material 110 if other processes would suitably affix the segments 120 to the periphery of the wheel 102.

As will be appreciated, the methods 1000 just described can be varied in accordance with the various elements and implementations described herein. That is, methods in accordance with the disclosed technology can include all or some of the steps or components described above and/or can include additional steps or components not expressly disclosed above. Further, methods in accordance with the disclosed technology can include some, but not all, of a particular step described above. Further still, various methods described herein can be combined in full or in part. That is, methods in accordance with the disclosed technology can include at least some elements or steps of a first method and at least some elements or steps of a second method.

While the present disclosure has been described in connection with a plurality of exemplary aspects, as illustrated in the various figures and discussed above, it is understood that other similar aspects can be used, or modifications and additions can be made to the described subject matter for performing the same function of the present disclosure without deviating therefrom. In this disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims.

What is claimed is:

1. An abrasive cutting tool comprising:

a plurality of segments arranged around a periphery of a cutting tool;

a first segment, of the plurality of segments, having;

a first portion disposed on a first side of the cutting tool and having a first concentration of abrasive material, a second portion disposed on a second side of the cutting tool and having the first concentration of abrasive material, and a third portion disposed between the first portion and the second portion and having a second concentration of abrasive material, the second concentration being less than the first concentration;

a second segment, of the plurality of segments, having;

a fourth portion disposed on the first side of the cutting tool and having a third concentration of abrasive material, a fifth portion disposed on the second side of the cutting tool and having the third concentration of abrasive material, and a sixth portion disposed between the fourth portion and the fifth portion and having a fourth concentration of abrasive material, the fourth concentration being less than the second concentration and greater than the third concentration, wherein the plurality of segments are arranged around the periphery of the cutting tool such that a second segment is disposed between two first segments.

2. The abrasive cutting tool of claim 1, wherein the plurality of segments are arranged around the periphery of the cutting tool such that at least six first segments are arranged consecutively and at least six second segments are arranged consecutively.

3. The abrasive cutting tool of claim 1, wherein the first portion, the second portion, and the third portion each extend along a length of each first segment from a first end to a second end of the first segment in a cutting direction of the abrasive cutting tool, and wherein the fourth portion, the fifth portion, and the sixth portion each extend along a length of each second segment from a first end to a second end of the second segment in the cutting direction of the abrasive cutting tool.

4. The abrasive cutting tool of claim 1, wherein:

the first concentration of abrasive material comprises abrasive material that is randomly dispersed throughout the first portion and the second portion;

the second concentration of abrasive material comprises abrasive material that is randomly dispersed throughout the third portion;

the third concentration of abrasive material comprises abrasive material that is randomly dispersed throughout the fourth portion and the fifth portion; and the fourth concentration of abrasive material comprises abrasive material that is randomly dispersed throughout the sixth portion.

5. The abrasive cutting tool of claim 1, wherein:

the first concentration of abrasive material comprises abrasive material that is arranged in an array throughout the first portion and the second portion;

the second concentration of abrasive material comprises abrasive material that is arranged in an array throughout the third portion;

the third concentration of abrasive material comprises abrasive material that is arranged in an array throughout the fourth portion and the fifth portion; and the fourth concentration of abrasive material comprises abrasive material that is arranged in an array throughout the sixth portion.

6. The abrasive cutting tool of claim 5, wherein:

the first concentration of abrasive material comprises arranging the abrasive material in the array by spacing each piece of abrasive material a first distance from an adjacent piece of abrasive material;

the second concentration of abrasive material comprises arranging the abrasive material in the array by spacing each piece of abrasive material a second distance from an adjacent piece of abrasive material, the second distance being greater than the first distance;

the third concentration of abrasive material comprises arranging the abrasive material in the array by spacing each piece of abrasive material a third distance from an adjacent piece of abrasive material; and the fourth concentration of abrasive material comprises arranging the abrasive material in the array by spacing each piece of abrasive material a fourth distance from an adjacent piece of abrasive material, the fourth distance being greater than the third distance and less than the second distance.

7. The abrasive cutting tool of claim 1, wherein each segment of the plurality of segments abut an adjacent segment of the plurality of segments such that the plurality of segments extend continuously along the periphery of the abrasive cutting tool in a first direction.

8. An abrasive cutting tool comprising:

a plurality of segments arranged around a periphery of a cutting tool;

a first segment, of the plurality of segments, having a first portion having a first concentration of abrasive material suspended in a first matrix material, and a second portion having a second concentration of abrasive material approximately equal to the first concentration of abrasive material suspended in a second matrix material, the first matrix material having a greater hardness than the second matrix material such that the first portion is more durable than the second portion;

a second segment, of the plurality of segments, having a third portion having a concentration of abrasive material approximately equal to the first concentration of abrasive material suspended in a third matrix material, and a fourth portion having a concentration of abrasive material approximately equal to the first concentration of abrasive material suspended in a fourth matrix material, the third matrix material having a hardness approximately equal to the hardness of the first matrix material and the fourth matrix material having a hardness approximately equal the hardness of the second matrix material;

wherein the first portion and the fourth portion are each disposed on a first side of the cutting tool; and wherein the second portion and the third portion are each disposed on a second side of the cutting tool.

9. The abrasive cutting tool of claim 8, wherein the first matrix material, the second matrix material, the third matrix material, and the fourth matrix material comprises a metal-based matrix material.

10. The abrasive cutting tool of claim 8, wherein the abrasive material is randomly dispersed throughout the first portion, the second portion, the third portion, and the fourth portion.

11. The abrasive cutting tool of claim 8, wherein the abrasive material is arranged in an array throughout the first portion, the second portion, the third portion, and the fourth portion.

* * * * *